US008070006B2

(12) United States Patent
Austin et al.

(10) Patent No.: US 8,070,006 B2
(45) Date of Patent: Dec. 6, 2011

(54) DEPLOYABLE AND DISPOSABLE CONTAINER ASSEMBLIES WITH BENDABLE SUPPORT MEMBERS

(75) Inventors: Ed Austin, Mountain View, CA (US); William J. Ritter, Bozeman, MT (US); Martin Albini, Bozeman, MT (US)

(73) Assignee: Evergreen Innovation Partners I, LP, Englewood, CO (US)

( * ) Notice: Subject to any disclaimer, the term of this patent is extended or adjusted under 35 U.S.C. 154(b) by 434 days.

(21) Appl. No.: 11/412,628

(22) Filed: Apr. 26, 2006

(65) Prior Publication Data

US 2007/0253648 A1 Nov. 1, 2007

(51) Int. Cl.
*A45C 7/00* (2006.01)

(52) U.S. Cl. ..... 220/9.2; 220/4.28; 220/6; 220/666; 229/117.03; 248/97; 248/99; 248/150; 248/528; 248/529; 267/159; 383/104

(58) Field of Classification Search ..... 220/6, 666, 220/9.2, 9.3, 4.28; 135/125, 126, 128, 132, 135/143, 154; 248/150, 151, 528, 529, 97, 248/99; 16/225–227; 267/159; 52/108
See application file for complete search history.

(56) References Cited

U.S. PATENT DOCUMENTS

| | | | | | |
|---|---|---|---|---|---|
| 131,303 | A | * | 9/1872 | Sabin | 383/121.1 |
| 325,751 | A | * | 9/1885 | Lawson | 220/9.1 |
| 651,773 | A | * | 6/1900 | Smith | 248/97 |
| 1,052,379 | A | * | 2/1913 | Ranken | 383/127 |
| 1,181,829 | A | * | 5/1916 | Bower | 220/9.3 |
| 1,283,152 | A | * | 10/1918 | Gleeson et. al. | 248/628 |
| 1,378,050 | A | * | 5/1921 | Morris | 248/99 |
| 1,533,636 | A | * | 4/1925 | Day | 206/8 |
| 1,583,083 | A | | 5/1926 | Macaraig | |
| 1,647,679 | A | * | 11/1927 | Williams | 220/9.2 |
| 1,906,174 | A | * | 4/1933 | Miller | 220/9.2 |
| 2,150,620 | A | * | 3/1939 | Frost | 220/9.2 |
| 2,405,627 | A | * | 8/1946 | Williams | 220/9.2 |
| 2,553,728 | A | | 5/1951 | Skreberg | |
| 2,791,367 | A | * | 5/1957 | Mefford | 229/101 |
| 2,795,259 | A | * | 6/1957 | Nash | 150/152 |
| 2,845,976 | A | * | 8/1958 | Miller | 229/100 |

(Continued)

OTHER PUBLICATIONS

"Lawn Bag Support" Harriet Carter. <http://www.harriestcarter.com/Detail.cfm?pth=23&Cat=116&prod=7997&sr=60> 2 Pages.

(Continued)

*Primary Examiner* — J. Gregory Pickett
*Assistant Examiner* — Ned A Walker
(74) *Attorney, Agent, or Firm* — Perkins Coie LLP

(57) ABSTRACT

Collapsible containers and associated methods are disclosed herein. Certain aspects of the invention are directed toward a collapsible container assembly that includes a foldable support member that has a length and a width. The support member has a concave cross-section that causes the support member to resist bending until a threshold force is exceeded. The support member has a folded position and an extended position where the support member is unfolded. The assembly further includes at least one surface member carried by the support member. The assembly has a deployed position where the support member is in the extended position and the at least one surface member forms an enclosure with an interior. The assembly also has a collapsed position where the support member is in the folded position. The container assembly has less exterior volume in the collapsed position than in the deployed position.

17 Claims, 14 Drawing Sheets

U.S. PATENT DOCUMENTS 3,014,516 A 12/1961 Mueller
3,107,712 A 10/1963 Bergeretto
3,386,128 A * 6/1968 Vyvyan ..... 16/225
3,474,488 A * 10/1969 Kruzich ..... 16/225
3,507,485 A * 4/1970 Bright ..... 267/182
3,658,282 A * 4/1972 Safford ..... 248/98
3,670,358 A * 6/1972 Schwartz et al. ..... 16/225
3,739,538 A * 6/1973 Rubin ..... 52/108
3,771,752 A 11/1973 Meeh
3,905,406 A * 9/1975 Cruse ..... 141/390
3,935,615 A * 2/1976 Wakeman ..... 16/227
4,157,801 A * 6/1979 Elmer ..... 248/97
4,248,364 A * 2/1981 Anderson ..... 383/6
4,482,116 A * 11/1984 Vadnais ..... 248/99
4,599,832 A * 7/1986 Benton et al. ..... 52/118
4,646,802 A 3/1987 Basore et al.
4,664,348 A * 5/1987 Corsaut et al. ..... 248/99
4,706,914 A * 11/1987 Ground ..... 248/74.3
4,739,880 A * 4/1988 Sawyer et al. ..... 206/223
4,759,518 A * 7/1988 Yardas ..... 248/97
4,846,427 A * 7/1989 Jones ..... 248/95
4,887,397 A * 12/1989 Peterson ..... 52/86
5,022,767 A 6/1991 Cardulla
5,033,232 A * 7/1991 Vaughn ..... 47/72
5,058,839 A 10/1991 Stevens
5,085,018 A * 2/1992 Kitamura et al. ..... 52/108
5,101,996 A * 4/1992 Mosley ..... 220/8
5,106,041 A * 4/1992 Jelincic ..... 248/99
5,149,028 A * 9/1992 Blackaby et al. ..... 248/101
5,176,452 A * 1/1993 Stern ..... 383/43
5,197,580 A * 3/1993 Berman et al. ..... 190/107
5,253,763 A * 10/1993 Kirkley et al. ..... 206/600
D347,577 S 6/1994 Dire
5,356,024 A * 10/1994 Ho et al. ..... 220/9.2
5,373,942 A * 12/1994 Weder ..... 206/423
5,375,048 A * 12/1994 Barnes ..... 362/352
5,393,023 A * 2/1995 Callan ..... 248/97
5,464,113 A * 11/1995 Ho et al. ..... 220/9.2
5,507,577 A 4/1996 Fowler
5,620,069 A * 4/1997 Hurwitz ..... 190/107
5,628,069 A * 5/1997 Ebert ..... 2/161.1
5,647,156 A * 7/1997 Hull et al. ..... 40/661
5,658,277 A * 8/1997 Marshall et al. ..... 606/34
5,671,858 A * 9/1997 Hsu ..... 220/9.2
5,678,717 A * 10/1997 Hsu ..... 220/4.28
5,713,510 A * 2/1998 Walton ..... 229/117.11
5,722,446 A * 3/1998 Zheng ..... 135/125
5,738,398 A * 4/1998 Miano ..... 294/1.1
5,800,067 A * 9/1998 Easter ..... 383/104
5,806,815 A * 9/1998 Knutson ..... 248/99
5,845,804 A * 12/1998 Prescott ..... 220/739
5,857,217 A * 1/1999 Hsueh ..... 2/170
5,857,722 A * 1/1999 Ayotte ..... 294/1.1
5,960,983 A 10/1999 Chan
5,964,533 A * 10/1999 Ziglar ..... 383/36
5,975,101 A * 11/1999 Zheng ..... 135/125
6,006,772 A * 12/1999 Zheng ..... 135/126
6,015,119 A * 1/2000 Starchevich ..... 248/65
6,019,244 A * 2/2000 Jones ..... 220/666
D422,390 S * 4/2000 Chipman ..... D34/6
6,053,459 A * 4/2000 Priefert et al. ..... 248/97
6,089,394 A * 7/2000 Ziglar ..... 220/6
6,102,569 A 8/2000 Wang
6,109,282 A * 8/2000 Yoon ..... 135/126
6,109,786 A * 8/2000 Hafer et al. ..... 383/119
6,112,930 A * 9/2000 McAtarian ..... 220/9.1
6,113,270 A * 9/2000 Hafer ..... 383/119
6,129,051 A * 10/2000 Jessie et al. ..... 119/452
6,149,025 A 11/2000 Wang
D434,890 S 12/2000 Cooper
6,155,281 A * 12/2000 Zheng ..... 135/126
6,155,521 A * 12/2000 O'Hanlon ..... 248/99
6,212,792 B1 * 4/2001 Bier ..... 34/315
6,217,975 B1 * 4/2001 Daton-Lovett ..... 428/105
6,244,399 B1 6/2001 Birkestrand
6,287,003 B1 * 9/2001 Hafer ..... 383/119
6,293,505 B1 9/2001 Fan
6,309,076 B1 * 10/2001 McVicker ..... 359/601
6,315,143 B1 11/2001 Dotts
6,321,503 B1 * 11/2001 Warren ..... 52/658
6,334,235 B2 * 1/2002 Duperray et al. ..... 16/225
6,343,442 B1 * 2/2002 Marks ..... 52/71
6,374,565 B1 * 4/2002 Warren ..... 52/653.2
6,375,385 B1 * 4/2002 Kennedy ..... 404/10
6,416,222 B2 * 7/2002 Hafer ..... 383/119
6,425,494 B1 * 7/2002 Woods, II ..... 220/739
6,446,919 B1 9/2002 Tsui
6,481,591 B2 11/2002 Mendoza et al.
6,484,897 B1 11/2002 Crawley
6,491,434 B2 * 12/2002 Hafer ..... 383/119
6,520,365 B2 2/2003 Schneider
6,543,732 B1 4/2003 Yuan
6,558,037 B2 * 5/2003 Gonella ..... 383/20
6,585,414 B2 7/2003 Peska
6,616,004 B1 9/2003 Erickson et al.
6,669,045 B2 * 12/2003 Wang ..... 220/9.2
6,676,092 B2 1/2004 Tsai et al.
6,688,516 B1 * 2/2004 Ussen ..... 229/198.2
6,712,286 B2 * 3/2004 Baxter et al. ..... 239/36
6,892,897 B2 5/2005 Stewart et al.
6,910,304 B2 * 6/2005 Warren ..... 52/108
6,920,993 B2 7/2005 Sheng-Bin et al.
7,009,578 B2 * 3/2006 Nolan et al. ..... 343/915
7,140,376 B2 * 11/2006 Zheng ..... 135/128
7,347,019 B1 * 3/2008 Shaw ..... 40/607.01
7,354,033 B1 * 4/2008 Murphey et al. ..... 267/160
7,494,096 B2 * 2/2009 Paloian et al. ..... 248/99
2001/0032911 A1 * 10/2001 Gabl ..... 248/99
2002/0030052 A1 3/2002 Joo-Tai
2002/0090150 A1 7/2002 Peska
2002/0144997 A1 10/2002 Mendoza et al.
2003/0015528 A1 1/2003 Schneider et al.
2003/0019180 A1 * 1/2003 Warren et al. ..... 52/646
2003/0098303 A1 5/2003 Wang
2003/0106895 A1 6/2003 Kalal
2003/0147568 A1 8/2003 Edwards et al.
2003/0182878 A1 * 10/2003 Warren ..... 52/108
2004/0155038 A1 * 8/2004 Smith ..... 220/9.2
2004/0232016 A1 11/2004 Dietrich
2005/0022465 A1 * 2/2005 Warren et al. ..... 52/653.2
2005/0199625 A1 * 9/2005 Salamone ..... 220/9.2
2005/0230390 A1 10/2005 Glenn
2005/0284866 A1 12/2005 Oakner et al.
2007/0257093 A1 * 11/2007 Lott ..... 229/117.05
2008/0056625 A1 3/2008 Stanton et al.

OTHER PUBLICATIONS

International Search Report and Written Opinion for PCT/US2007/067425; Applicant: Evergreen Innovation Partners I, LP; Date of Mailing: Sep. 10, 2008, 13 pages.

* cited by examiner

DEPLOYABLE AND DISPOSABLE CONTAINER ASSEMBLIES WITH BENDABLE SUPPORT MEMBERS

TECHNICAL FIELD

The present invention is related to deployable, disposable container assemblies and associated systems and methods.

BACKGROUND

Trash bags are commonly used to collect garbage and trash because they are convenient to use. For example, a trash bag can be used to line a trash can used in a home, office, or other facility. When the trash bag is full, the bag can be closed using a twist tie removed from the can and easily carried to a trash receptacle, such as a dumpster. Because the trash bag isolates the trash from the trash can, the trash can generally remains relatively clean for a while. The trash cans, however, typically gets dirty over time, and the process of cleaning a dirty trash can is often an unpleasant experience.

Trash bags are also convenient for use outside the home or office. For example, trash bags are often used in cars and other vehicles to collect lifter and trash. Additionally, trash bags are easily carried to various outdoor locations and used for trash collection (e.g., during camping trips, picnics, or parties). Trash bags can also be used to collect trash at large events, such as those held at auditoriums, gymnasiums, stadiums and convention centers. In many cases, conventional trash bags are also used for non-trash purposes. For example, trash bags are often used to cover or hold items during storage to protect the items from the external environment Although trash bags are convenient for trash collection, they are flexible and unsupported so they generally require a trash can or other structure to hold the trash bag open. When a trash can or other support is not used with the trash bag, the trash bag can be very cumbersome and difficult to use and hold open. For example, a user often must hold the trash bag open with one hand while trying to deposit the trash or other item into the bags with the other hand.

Other collapsible containers have been used for a variety of temporary or long term storage purposes. For example a collapsible hamper has been used that includes a spiral coil connected to a bag-like structure. The collapsible hamper can pop up and provide a receptacle structure with an open top. The spiral coil, however, does not provide lateral or vertical stability for the hamper when in the popped up position. For example, the hamper will easily collapsed or distort if a vertical and/or horizontal loads are applied to the top lip of the hamper.

SUMMARY

The present invention is directed generally toward deployable containers and associated systems and methods. One aspect of the invention is directed toward a disposable, deployable container assembly comprising a support member movable between a substantially straight, extended position and a folded position. The support member is configured to resist axial loads when in the extended position. The support member is foldable along a non-hinged portion through a range of at least 90 degrees as the support member moves from the extended position toward the folded position. The assembly has first and second end members and a collapsible sidewall connected thereto. At least one of the first end member, second end member, and sidewall is coupled to the support member.

The assembly has a deployed position where the support member is in the extended position and the first and second end members are spaced apart from each other and combine with the sidewall to form a disposable enclosure with an interior. The first end member has an opening that provides access to the interior of the enclosure when the assembly is in the deployed position. The assembly has a collapsed position where the support member is in the folded position and at least a portion of the first and second end members are adjacent to each other.

Another embodiment provides a deployable container assembly that includes a foldable support member that has a concave cross-sectional shape, the support member configured to support axial loads and resist bending across its length when the support member is in the extended position. The foldable support member has a folded position where the support member is folded across its length and an extended position where the support member is unfolded. The assembly further includes at least one surface member coupled to the support member. The assembly has a deployed position where the support member is in the extended position and the surface member forms an enclosure with an interior. The assembly also has a collapsed position where the support member is in the folded position. The container assembly has an exterior volume in the collapsed position less than its exterior volume when in the deployed position.

Another aspect of the invention is directed toward a method for making a deployable container assembly that includes providing a foldable support member. The foldable support member has a folded position wherein the support member is folded across its length and an extended position wherein the support member is unfolded. The support member has a concave cross-sectional area and is configured to support axial loads and resist bending when in the extended position. The method further includes coupling at least one surface member to the support member so that the container assembly can move between a deployed position and a collapsed position. In the deployed position the support member is in the extended position and the surface member is supported by the support member to form an enclosure with an interior. In the collapsed position the support member is in the folded position.

DETAILED DESCRIPTION

The present disclosure describes deployable container assemblies and associated systems and methods. Several specific details of the invention are set forth in the following description and in FIGS. 1-39 to provide a thorough understanding of certain embodiments of the invention. One skilled in the art, however, will understand that the present invention may have additional embodiments, and that other embodiments of the invention may be practiced without several of the specific features described below.

Figure 1:
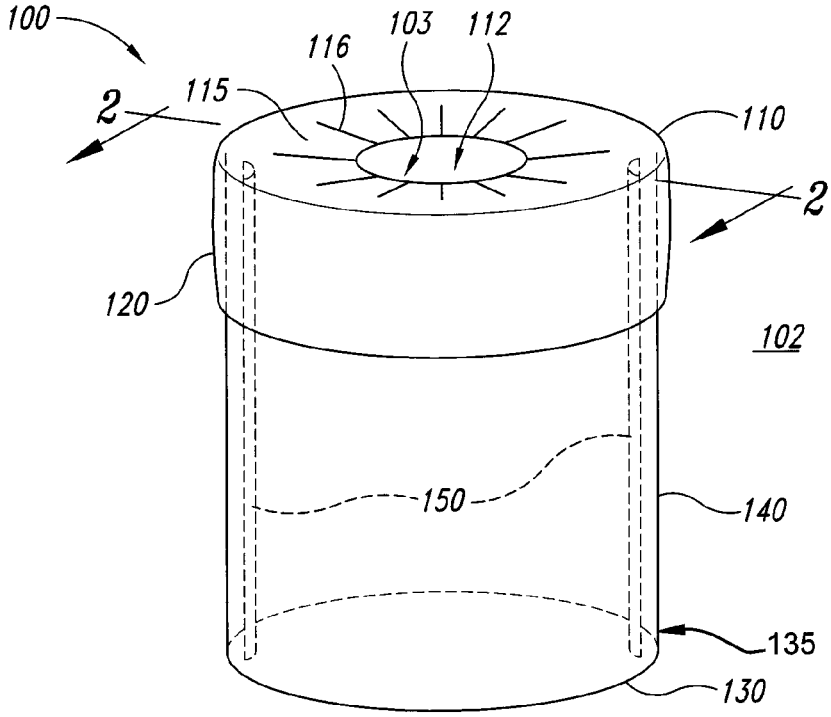
FIG. 1 is an isometric view of a disposable, deployable container assembly in accordance with an embodiment of the invention shown in a deployed position.
Figure 2:
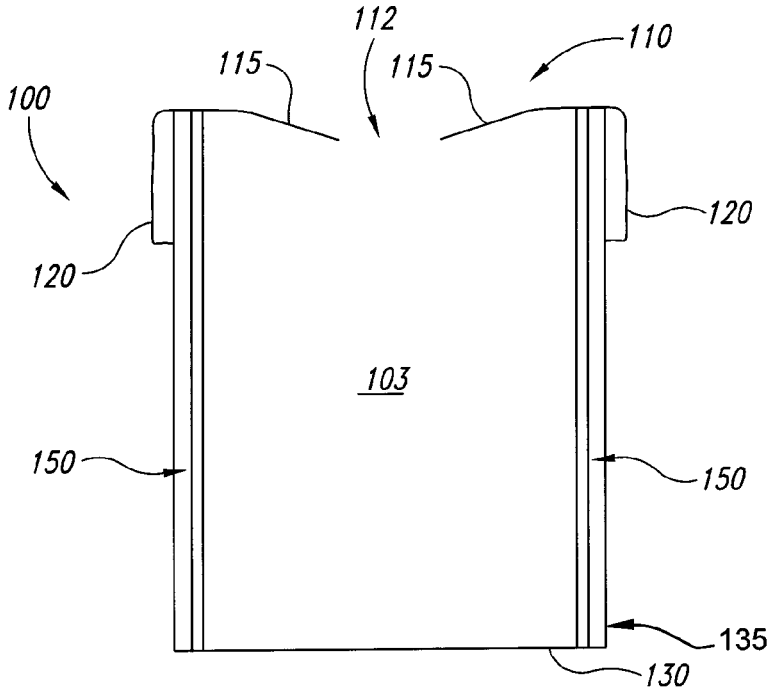
FIG. 2 is a partially schematic cross-sectional illustration of the assembly taken substantially along line 2-2 of FIG. 1.
Figure 3:
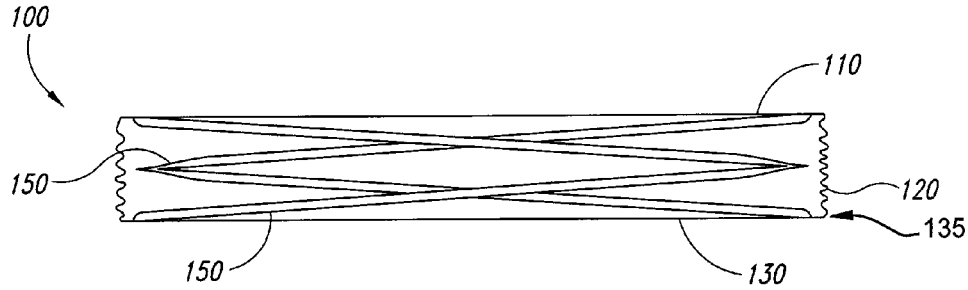
FIG. 3 is a partially schematic cross-sectional illustration of the assembly of FIG. 2 shown in a collapsed position.

FIGS. 1-3 show a deployable, disposable container assembly 100 in accordance with an embodiment of the invention. The assembly 100 of at least one embodiment has a foldable support member 150 having a length and a width. The support member 150 has a folded position where the support member is folded across its length and an extended position where the support member is unfolded. A surface member 135 is coupled to the support member 150. The assembly 100 has a deployed position where the support member 150 is in the extended position and the surface member 135 forms an enclosure with an interior. The assembly 100 has a collapsed position where surface member 135 is collapsed and the support member 150 is in the folded position. The assembly 100, when deployed, is a free standing disposable container that includes one or more support members 150 coupled to sidewalls 140 that extend between spaced apart top and bottom members 110 and 130 (e.g., end members). The support members 150 extend between the top and bottom members 110 and 130. The surface member 135 is coupled to the top and bottom members 110 and 130. In one embodiment, the support members 150 carry the surface member 135 via the top and bottom members 110 and 130. The surface member 135 and at least one of the top and bottom members 110 and 130 are substantially water resistant and configured to contain liquid within the interior. In the illustrated embodiment. The support members 150 are securely connected to the top and bottom members 110 and 130 to form a frame or support structure that retains the assembly 100 in the free-standing, deployed position with the top member 110 held apart from the bottom member 130 and the sidewalls 140 extending therebetween. Accordingly, the top member 110, the sidewalls 140 and the bottom member 130 define an interior area 103 that can contain and retain items placed into the container. In one embodiment, the assembly 100 is configured to be a free standing, disposable container assembly that receives and contains trash, recyclables, yard waste or other refuse. When the assembly has been filled or partially filled, the entire assembly and its contents can be thrown away, recycled, or otherwise disposed of quickly, cleanly and easily as a unit. The assembly 100 of the illustrated embodiment also has a closure device 120 connected to the flexible sidewalls 140 and/or to the top member 110 that allows the assembly 100 to be securely closed, thereby retaining the contents within the assembly.

The surface member 135 includes a flexible material. In the illustrated embodiment, the sidewalls 140 are flexible or semi-flexible sidewalls made from cloth, plastic, paper or other sufficiently durable material that allow the assembly 100 to move to the deployed position shown in FIG. 1 from a collapsed position shown in FIG. 3, as discussed in greater detail below. The sidewalls 140 in one embodiment are made from a material that is substantially impervious to water or other liquids. Accordingly, the assembly 100 could be used as a disposable collector of trash that may include liquids, and the liquids would be fully contained within the interior area 103. In various embodiments, the sidewalls 140 can include multiple panels or be one continuous sheet. In one embodiment, the sidewalls 140 can be made of a puncture-resistant material. The sidewalls 140 can also be integrally connected to portions of the bottom member 130 and/or the top member 110.

In the illustrated embodiment, the top member 110 includes an opening 112 between an exterior 102 of the assembly 100 and the interior area 103 of the assembly 100. The opening 112 is shaped and sized so selected items can be placed into the interior area 103 through the opening in the top member 110. The opening 112 can have anyone of a variety of shapes, and the top member 110 can include more than one opening with the same or different shapes. In one embodiment, the top member 100 is a substantially planar piece of cardboard or plastic with a hole formed therein to define the opening 112. In another embodiment, the top member 110 is a ring, so the opening 112 is defined by the inner diameter of the ring. The top member 110 can include a plurality of flexible fingers 115 and slots 116 around the opening 112. The fingers 115 can be positioned downwardly toward the interior area 103 so that the fingers 115 can direct items toward the interior 103 of the assembly 100. The fingers 115 are moveable so the opening 103 can be enlarged when needed. The fingers 115 also help keep items within the interior area 103 from falling out.

In FIG. 1, the bottom member 130 provides a base or bottom portion of the assembly and does not have any openings so that the container is fully sealed except for the opening 112 in the top member 110. In one embodiment, the bottom member 130 is made from a water impervious material so the container will not leak through the bottom if fluid is in the container's interior area 103. In another embodiment the bottom member 130 can be made with a material that allows liquid to pass therethrough, thereby intentionally allowing fluid to exit the container through the bottom member. In one embodiment, the bottom member 130 is a substantially planar piece of cardboard or plastic. In another embodiment, the bottom member 130 is a ring (e.g., circular, square, or other geometric shape) covered by a layer of material, such as plastic, paper, or other sufficiently durable materials. In another embodiment, the bottom member 130 includes two or more cross members coupled to the sidewalls. The crossmember can be in a "+" configuration, a "*" configuration, or other intersecting configuration.

In the illustrated embodiment, the top and bottom members 110 and 130 include rigid or semi-rigid materials and provide a structural support for the upper and lower portions of the assembly 100. Accordingly, the top and bottom members 110 and 130 work with the support members 150 to provide a free-standing, disposable container when the assembly 100 is in the deployed position. In certain embodiments, the top and bottom members 110 and 130 can be made from cardboard, metal, wood, plastic, and/or coated cardboard that is water resistant. In still other embodiments, the top and/or bottom members 110 and 130 can be flexible or semi-rigid. For example, in selected embodiments the top and/or bottom members 110 and/or 130 can be made from a layer of material stretched across a support ring, frame portion, or outline.

In the embodiment illustrated in FIG. 1, the support members 150 are bendable struts that have a characteristic such that the strut tends to hold an extended position to provide structural stability to the container assembly 100 when in the deployed position. The struts are shown in their memory position in FIG. 1. If a force, such as a lateral or vertical force, above a predetermined threshold is applied, the struts can be temporarily moved to another shape (e.g., the struts can be folded in half along their length) allowing the container assembly 100 to move from the deployed position toward the collapsed position (shown in FIG. 3). In the collapsed position, struts are generally bent in one or more locations so that the top and bottom members 110 and 130 are generally adjacent to each other, and the flexible sidewalls 140 are generally folded. In the collapsed position, the assembly 100 is a compact, self-contained unit that takes up less total volume (e.g., less internal and external volume), thereby requiring less space for shipping or storage.

In the illustrated embodiment, the support members 150 are non-hinged members so they can bend at virtually any portion along their length. When the assembly 100 is released or otherwise moved from the collapsed position to the deployed position, the struts unfold and move toward a straight, extended position to the memory position, thereby holding the top and bottom members 110 and 130 apart from each other with the flexible sidewalls 140 extending therebetween. The struts can be sized so that top and bottom members 110 and 130 are held apart by a distance so that the flexible sidewalls are pulled taut and held in tension when the assembly is in the deployed position.

Figure 4:
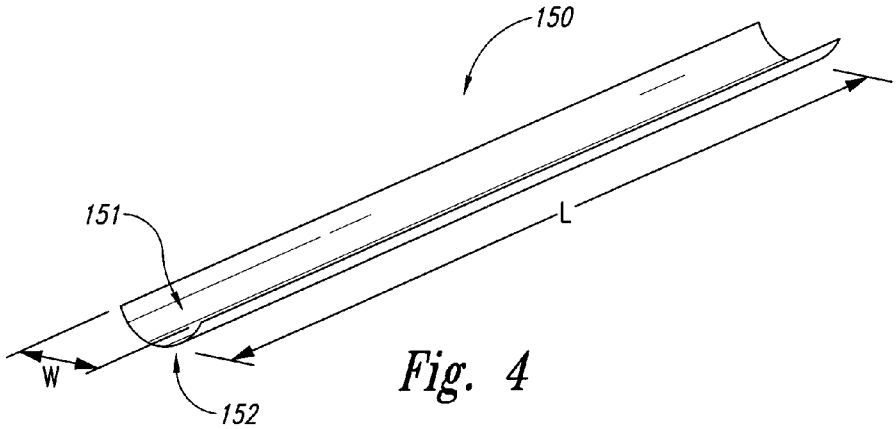
FIG. 4 is an isometric illustration of a support member from the assembly of FIG. 1 shown removed from the assembly and in an extended position.
Figure 5:
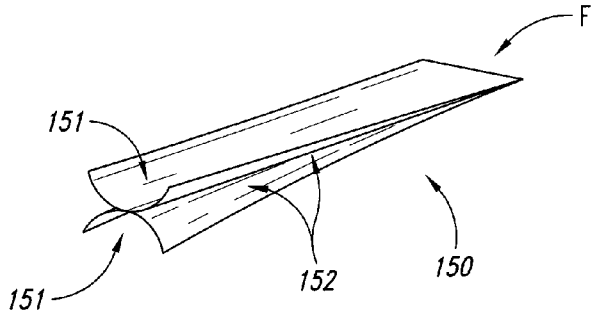
FIG. 5 is an isometric illustration of the support member of FIG. 4 in a folded position.

FIG. 4 is an isometric illustration of a support member 150 from the assembly 100 of FIG. 1 in an extended position. FIG. 5 is an isometric illustration of the support member 150 of FIG. 4 in a folded position. In FIG. 4, the support member 150 is a non-hinged, bendable member that has a generally accurate or curved profile or cross-sectional shape across its width W. This curved profile is a memory position of the support member 150 in that the support member tends to reestablish or seek to reestablish the curved profile when the curved profile is disturbed, such as when the support member is bent. For example, the support member 150 in FIGS. 4 and 5 includes the curved profile with a concave portion 151 and a convex portion 152. The curved profile of the support member 150 is configured to resist bending along the cross-section or width of the support member 150 because the curved profile must be disturbed (e.g., flattened) for the support member to bend, as seen in FIG. 5. When the support member 150 is in the extended position, it provides structural support that resists bending or supports vertical loads applied to the top member 110. Accordingly, when the container assembly is in the deployed position, it is a free standing unit that will not collapse under light to moderate vertical loads.

In the illustrated embodiment, when a bending force is applied to the support member 150 in excess of a threshold, a portion F of the support member can be flattened, as shown in FIG. 5. The support member 150 can be bent or folded through various intermediate positions (e.g., similar to bending a retractable tape measure) to the folded position shown in FIG. 5. Once the support member 150 is bent or folded, it can be retained in the bent position until a force is applied to unfold the support member 150 toward the extended position.

In one embodiment, the support member 150 is shaped and is configured to be biased toward the extended position. The support member 150 is made of a material that does not have a memory for the folded position and will be biased toward the fully extended position independent of duration and temperature while the assembly is stored in the collapsed position. Accordingly, the assembly 100 can be released or otherwise moved from the collapsed position, and the support members 150 will automatically move to the extended position, thereby fully deploying the assembly 100 to the deployed positions.

In another embodiment, the support members 150 are shaped and configured so that they will tend to remain in the folded position until they are moved to a selected intermediate position, and then the tendency for the support members 150 to return to the curved profile provide an urging force to continue unfolding the support members 150 to the extended position, thereby moving the assembly to the fully deployed position. In other embodiments, the support members' tendency to reestablish the curved profile can provide an urging force to unfold the member 150 from any folded position. In still other embodiments, the support member 150 can be manually unfolded in order to straighten the member 150 to the extended position. In other embodiments, the support member 150 can include other types of memory and/or resilient characteristics. In the illustrated embodiment, the support members 150 are made of a flexible metallic material, although other flexible and resilient materials, for example, plastic, or composites could be used.

The assembly 100 in alternate embodiments can be made from various materials and/or can have various characteristics, sizes, and shapes. For example, in selected embodiments the top and bottom members 110 and 130 and/or the sidewalls 140 can be made from a breathable material, a water resistant material, or both. In selected embodiments, at least a portion of the assembly 100 can be configured as a portable, disposable cooler, which can carry ice. In other embodiments, the assembly 100 can be configured to be recyclable and/or combustible (e.g., for incineration). For example, the top and bottom members 110 and 130 and surface member 135, including the sidewalls 140 can be made from a biodegradable corn resin, and the strut 150 can be made from a metallic material treated with a rust accelerant so that the assembly 100 will breakdown or disintegrate in a landfill relatively quickly. In other embodiments, various portions of the assembly 100 can be made from recyclable materials such as metal, plastic, and the like.

Figure 6:
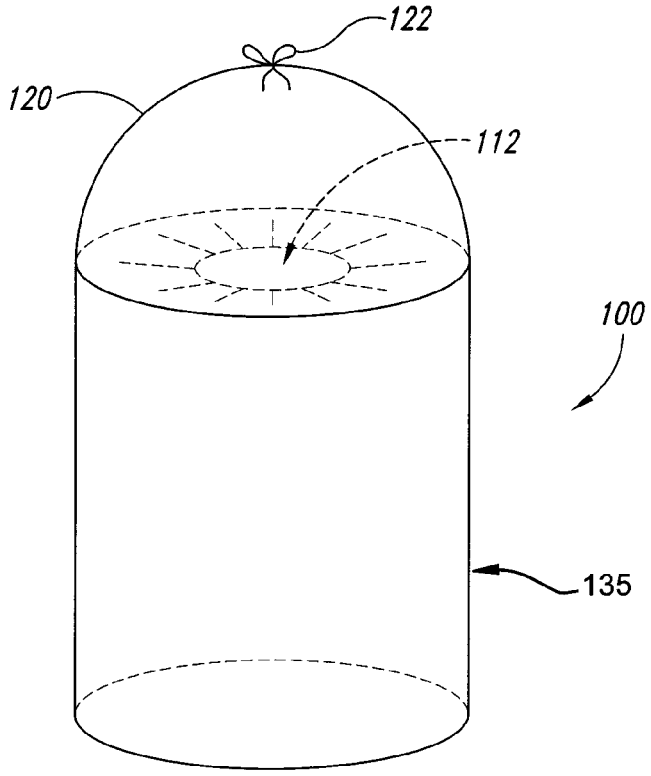
FIG. 6 is an isometric illustration of the assembly of FIG. 1 with a closure device covering an opening in a top member of the assembly.

FIG. 6 is an isometric illustration of the deployable container assembly 100 of FIG. 1 with a closure device 120 shown covering the top member 110 of the assembly 100 and the opening 112 in the top member. In FIG. 6, the closure device 120 is shown in the closed position covering the opening 112 to help retain items within the interior area 103. The closure device 120 can be moved from the open position and held in closed position by a fastener device 122 (e.g., a drawstring).

The closure device 120 is coupled to at least one of the surface member 135 the top member 110. In the illustrated embodiment, the closure device 120 includes a flexible skirt portion internally connected to the sidewalls 140 adjacent to the top member 110. The skirt portion is configured to hang in an open position (shown in FIGS. 1 and 2) around the exterior of the sidewalls 140 below the top member 110 when the assembly is in the deployed position. The skirt portion can be lifted above the top member and moved to the closed positions by pulling on the drawstring, thereby circling the skirt portion closed and enclosing the top member 110 therein. In certain embodiments, the closure device 120 can be pulled up to cover overflow materials or items that may project through the opening 112 and above the top member 110. Accordingly, the container assembly 100 can be configured with an intentional overflow capacity while still being able to cleanly and adequately contain the trash or other items placed into and onto the container assembly 100.

In other embodiments the closure device 120 and/or the fastener device 122 can include other configurations. For example, the closure device 120 can be a flap or door that covers the opening 112 in the top member 110. The fastener device 122 can include tape, Velcro®, or a twist tie. In still other embodiments, the top member 110, bottom member 130, or sidewalls 140 can include an integral closure feature. In selected embodiments, the top member 110 is crushable and can be crushed as the closure device 120 is secured over the assembly 100 to form a compact package when a partially filled assembly 100 is closed in preparation for disposing of the container assembly and its contents as a unit.

Figure 7:
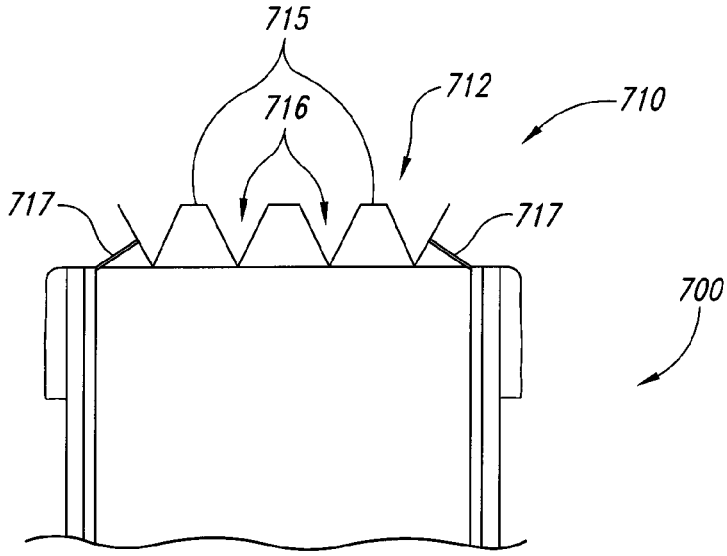
FIG. 7 is a partially schematic cross-sectional illustration of a first surface member of a deployable container assembly in accordance with another embodiment of the invention.

In other embodiments, the deployable container assembly 100 can have other configurations. For example, FIG. 7 is a partially schematic cross-sectional illustration of a top member 710 of a deployable container assembly 700 in accordance with another embodiment of the invention. In FIG. 7, the top member 710 has an opening 712 that provides access into the interior area. The top member 710 has a plurality of fingers 715 and slots 716 surrounding an opening 712 similar to the fingers, slots, and opening discussed above with reference to FIG. 1. However, the fingers 715 can be folded or slanted upwardly and radially outwardly away from the opening 712 to an open position. Propping mechanisms 717 can be used to prop or secure the fingers 715 in the open position. The propping mechanisms 717 can be integral with the top member 710 or they can be separate from and/or connectable to the top member. In the deployed position, the fingers 715 are configured to funnel items into the opening 712 and also provide lateral support for any overflow material that extends upwardly beyond the opening 712. The fingers 715 can also be folded radially inwardly and downwardly toward the opening 712 partially or fully to close the opening. In one embodiment, the fingers 715 extend toward the center of the opening 712 so that they completely cover the opening 712 when in the stowed position.

Figure 8:
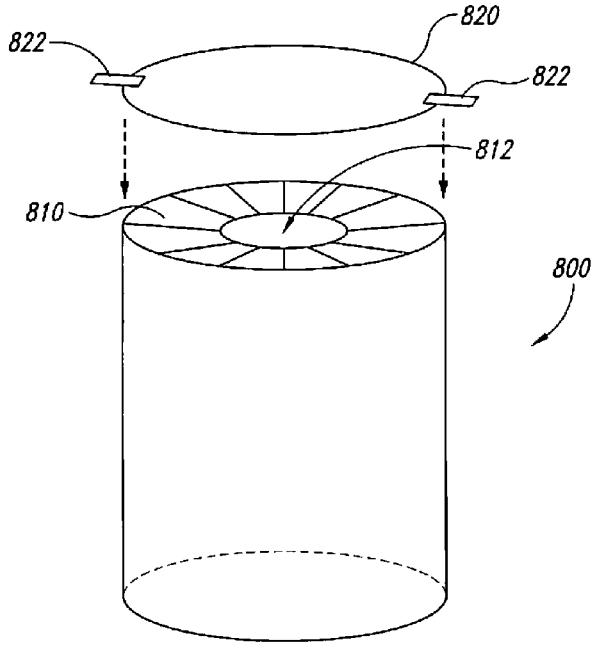
FIG. 8 is an isometric illustration of a deployable container assembly with a closure device in accordance with an embodiment of the invention.

FIG. 8 is an isometric illustration of a deployable container assembly 800 with a closure device 820 in accordance with another embodiment of the invention. In FIG. 8, a closure device 820 includes a rigid disk, semi-rigid disk, or membrane configured to be placed over at least a portion of an opening 812 of a top member 810. The closure device 820 can be separable from the top member 810, or it can be securely or integrally attached and positionable over the opening 812. Fastening devices 822 can be used to secure the closure device 820 to the assembly 800. The fastening devices 822 can include tape, Velcro®, tabs, detents, or the like.

Figure 9:
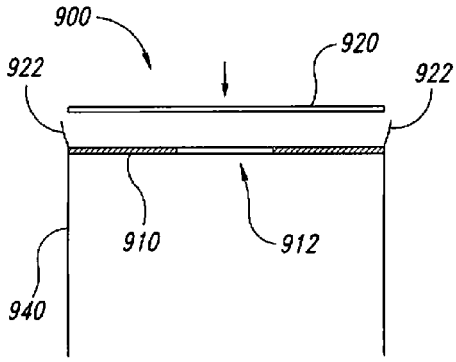
FIGS. 9 and 10 are partially schematic illustrations of a deployable container assembly with a closure device in accordance with embodiments of the invention.
Figure 10:
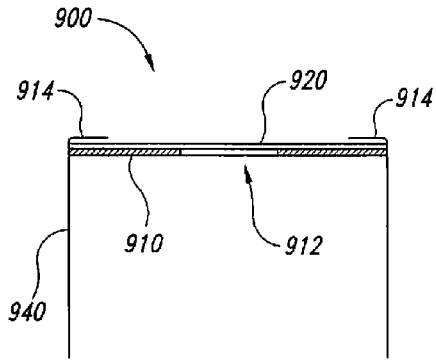
Figure 11:
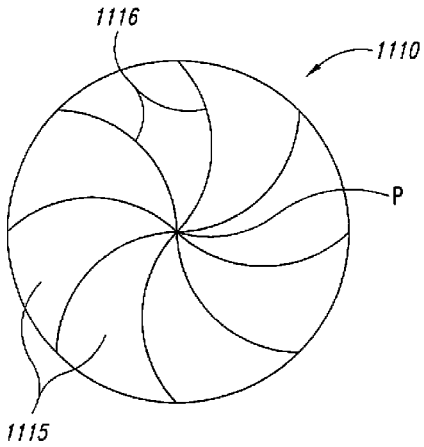
FIGS. 11-14 are partially schematic illustrations of a top member of a deployable container assembly in accordance with an embodiment of the invention.
Figure 12:
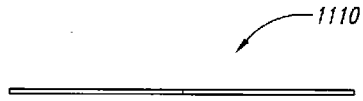

FIGS. 9 and 10 are partially schematic illustrations of a deployable container assembly 900 with a closure device 920 positionable adjacent to an opening in the top member 110 in accordance with another embodiment of the invention. In FIG. 9, the top member 910 of the assembly 900 includes two fastening devices 922 in the form of foldable flanges extending vertically away from the top member 910. The closure device 920 (e.g., a disk or membrane) is positioned proximate to at least a portion of an opening 912 in the top member 910, and the flanges are folded over the closure device 920 to releasably securing it in place. In other embodiments, the flanges can be connected to other portions of the assembly 900, for example, to a portion of the sidewalls 940. In still other embodiments, the fastening devices 922 can have other configurations. For example, in certain embodiments the fastening devices 922 can include a foldable or crushable lip that extends around and engage at least a portion of the top member 910, which can be used to secure the closure member 920 in place over the opening 912 in the top member.

FIGS. 11-14 are partially schematic illustrations of a top member 1110 of a collapsible container assembly that includes a closure feature in accordance with another embodiment of the invention. In the illustrated embodiment, the top member 1110 is movable between an open and a closed position.

Figure 13:
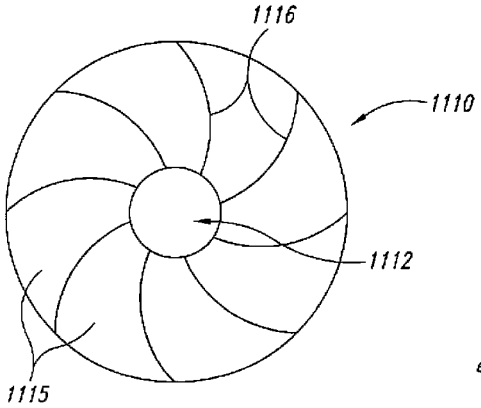
Figure 14:
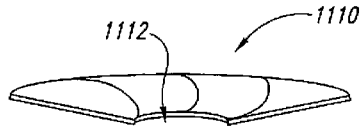

The top member 1110 includes curved fingers 1115 separated by slots 1116. In the closed position, the fingers 1115 can at least partially overlap with one another to form a generally continuous surface. The top member can be moved from the closed position to the open position by applying a force proximate to a selected point P (shown in FIG. 11). As the top member moves from the closed position to the open position, distal ends of the fingers 1115 move downwardly and radially outwardly (as shown in FIGS. 13 and 14, which is a cross-sectional side elevation view of the top member 1110 shown in FIG. 13), thereby creating an opening 1112 in the top member 1110 to provide access into the assembly's interior area. In certain embodiments, the fingers 1115 can have a memory characteristic so that they automatically return to the closed position when the force is released.

Figure 15:
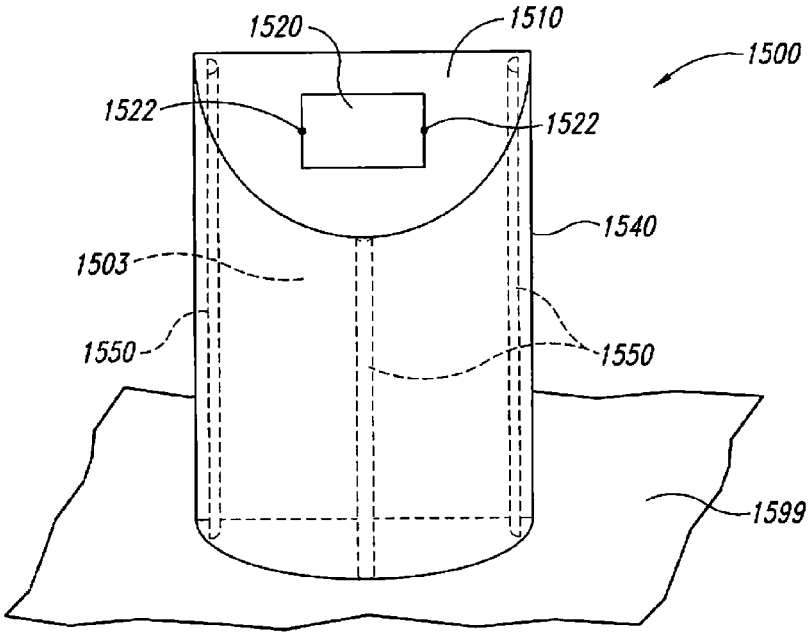
FIG. 15 is an isometric illustration of a deployable container assembly with a slanted top member and a closure device in accordance with an embodiment of the invention.
Figure 16:
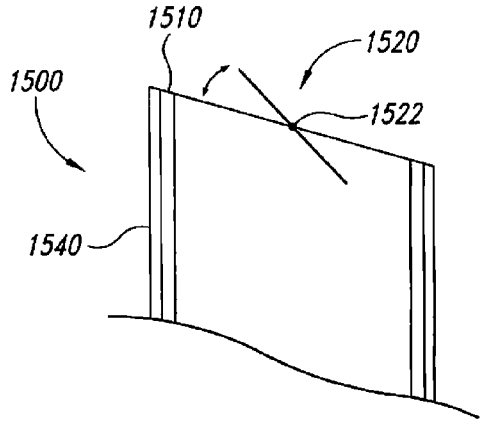
FIG. 16 is a partially schematic cross-sectional illustration of a portion of the deployable container assembly shown in FIG. 15.

FIG. 15 is an isometric illustration of a deployable container assembly 1500 with a slanted top member 1510 coupled to the sidewalls 1540 in accordance with yet another embodiment of the invention. FIG. 16 is a partially schematic cross-sectional illustration of a portion of the deployable container assembly shown in FIG. 15. In the illustrated embodiment, the top member 1510 includes an opening 1512 that provides access into the assembly's interior area 1503. The top member 1510 and the opening 1512 are oriented at a non-perpendicular angle relative to a longitudinal axis L of the container assembly 1500 that extends through the interior area in the illustrated embodiment. Accordingly, the top member 1510 and its opening 1512 are oriented at an angle relative to the sidewalls 1540 when the container assembly 1500 is in the deployed position. The slanted top member 1510 can be particularly useful when the assembly 1500 (in the deployed position) is used in an area where space above the container assembly 1500 is limited or restricted. For example, if the container assembly 1500 is used as a disposable, under-counter trash receptacle, the opening 1512 is better accessible from the side of the deployed container assembly.

In the illustrated embodiment, the top member 1510 is a generally planar member made of plastic, cardboard, wood, paper, or other fairly stiff material that will hold its shape and that will hold the upper portion of the sidewalls 1540 in an open position that provides substantially unobstructed access into the interior area 1503 when the assembly 1500 is in the deployed position. The top member 1510 is securely attached to the sidewalls 1540 around the top member's perimeter. In the illustrated embodiments, the entire top member is oriented at a non-perpendicular angle relative to the longitudinal axis L. In another embodiment, the top member can have a flat portion (i.e., generally perpendicular to the longitudinal axis) and a sloped section (i.e., non-perpendicular to the longitudinal axis) connected to the flat section. The opening 1512 can be formed in just the sloped section, or the opening can be formed in both the slanted section and the flat section. In another embodiment, multiple openings 1512 can be provided in the top member 1510.

The container assembly 1500 of the illustrated embodiment includes three bendable or collapsible struts 1550, generally similar to the support members discussed above with reference to FIGS. 1-6. At least one of the struts 1550 is longer than the other struts such that, when the container assembly 1500 is moved from the collapsed position to the deployed position, the top member 1510 will automatically be oriented in the slanted configuration. In other embodiments, the assembly 1500 can have more or fewer struts 1550 with the different lengths as needed to support the top member 1510 in the slanted configuration when in the deployed position.

In the illustrated embodiment, the top panel 1510 includes a closure device 1520 positionable to cover the opening 1512. In one embodiment, the closure device 1520 is a rotating panel, pivotally coupled to the top member 1510 by two fastening devices 1522 that define an axis of rotation of the panel. The rotating panel is configured so that when a force is applied to the panel at a point away from the axis of rotation, the panel rotates relative to the opening 1512 so as to uncover at least a portion of the opening 1512. In selected embodiments, the panel can be balanced so that, when the force is removed, the panel automatically returns to a closed position so that the panel substantially covers the opening 1512.

In other embodiments, the closure device 1520 can include a detent to hold the closure device in any of an open position, a closed position, or an intermediate position. In still other embodiments, the closure device 1520 can include a friction device that resists or restricts movement of the closure device, thereby causing the closure device to remain in a selected position unless an external force is applied to it. When the closure device 1520 is in the closed position the entire container assembly 1500 and its contents can be easily and cleanly thrown away, recycled, or otherwise disposed of as a unit.

Figure 17:
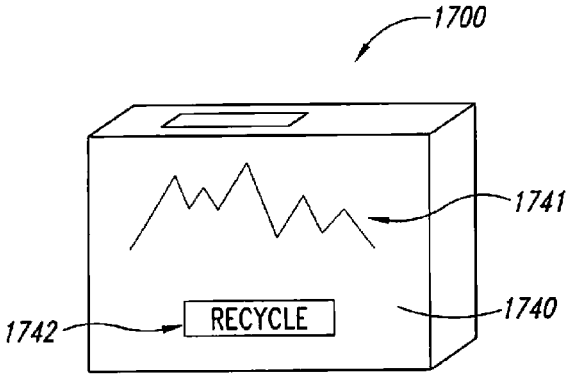
FIG. 17 is an isometric illustration of a deployable container assembly with markings on a portion of the assembly in accordance with an embodiment of the invention.

FIG. 17 is an isometric illustration of a deployable container assembly 1700 of another embodiment having a construction generally similar to the embodiments described above. In addition, the sidewalls 1740 includes a printed marking 1741 and/or a labeling area 1742. The printed marking 1741 can include text, images, designs, indicia symbols, logos, or other markings. In one embodiment, the printed marking 1741 includes information (e.g., text and/or images) associated with an intended designated use of the assembly 1700. In another embodiment, the markings 1741 can include advertising and/or a decorative design (e.g., a seasonal decoration scheme). The sidewalls 1740 can be constructed of a flexible material, such as plastic, paper, or the like onto which the markings 1741 can be directly printed or applied thereto. In another embodiment, the container assembly 1700 can have transparent or translucent pouches connected to the sidewalls 1740 or other locations. The pouches are configured to removably receive inserts so the inserts are visible from the exterior of the assembly. The pouches can receive custom printed inserts with text, designs, logos or other indicia thereon. For example, an insert can be customized for a particular event at which the container assembly would be use, or the insert can be provided with a message or image related to the event. Other inserts or indicia devices could be used with the pouches in other embodiments.

The labeling area 1742 can include a portion of the assembly 1700 configured for labeling by the consumer. For example, the labeling area 1742 can include an area of the sidewall 1740 configured to receive preprinted labels and/or an area configured to be written on with an indelible marker or the like. Although the printed design 1741 and the labeling area 1742 are shown positioned on the sidewalls 1740, in other embodiments the printed designs 1741 and the labeling areas 1742 can be located on any portion of the disposable, deployable container assembly 1700.

Figure 18:
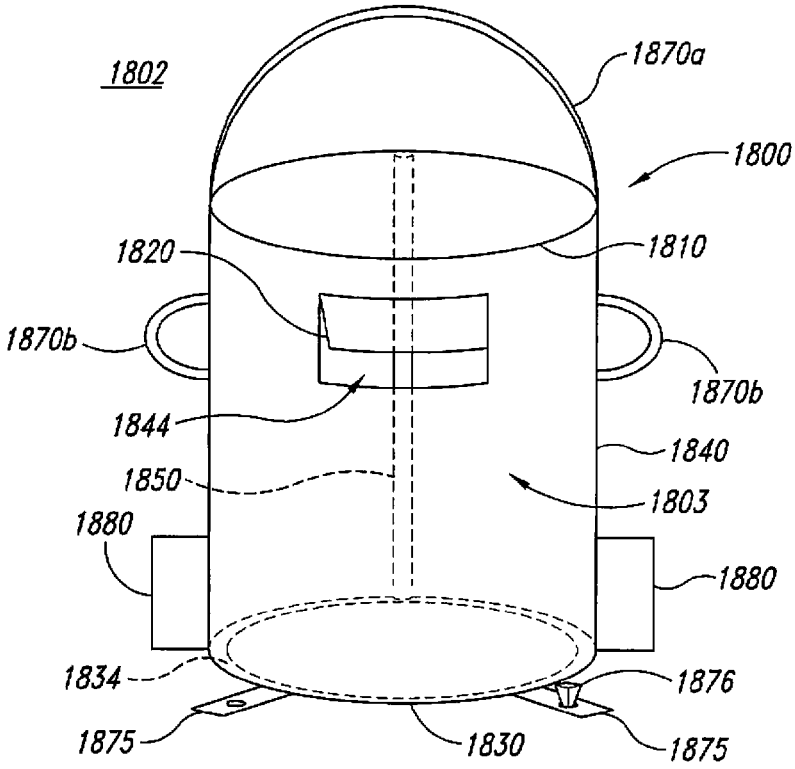
FIG. 18 is an isometric illustration of a deployable container assembly with handling devices, securing devices, and storage devices in accordance with embodiments of the invention.
Figure 19:
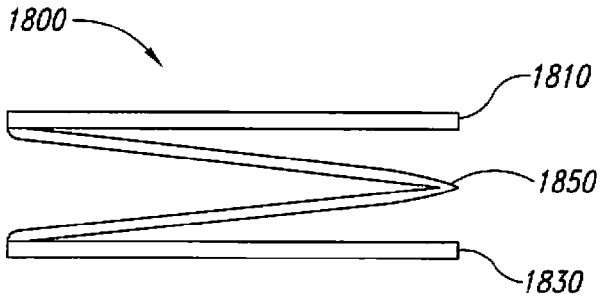
FIG. 19 is a partially schematic cross-sectional illustration of a portion of the deployable container assembly of FIG. 18 shown in a collapsed position.

FIG. 18 is an isometric illustration of a deployable container assembly 1800 with handling devices 1870, securing devices 1875, and storage devices 1880 in accordance with another embodiment of the invention. In the illustrated embodiment, the container assembly 1800 has only a single strut 1850 extending between a top member 1810 and a bottom member 1830. Other embodiments can have multiple struts 1850 extending between the top and bottom members 1810 and 1830. The flexible sidewalls 1840 also extend between the top and bottom member 1810 and 1830 creating an enclosure with an interior area 1803 into which items can be placed. In FIG. 18, the strut 1850 is similar to the support members discussed above with reference to FIGS. 4 and 5. FIG. 19 is a partially schematic cross-sectional illustration of a portion of the deployable container assembly 1800 of FIG. 18 shown in a collapsed position. In the illustrated embodiment, the sidewalls 1840 have been removed for the purposes of clarity and illustration. In FIG. 19, the single strut 1850 has been bent or folded as the top member 1810 and the bottom member 1830 are moved toward one another.

In the illustrated embodiment in FIG. 18, the sidewall 1840 includes the opening 1844 that provides access into the interior area 1830. In other embodiments, the opening 1844 can be in the top member 1810. The container assembly 1800 can also include a closure device 1820 that movably covers the opening 1844 similar to the closure devices described above. The handling devices 1870 of the illustrated embodiment, shown as first and second handles 1870*a* and 1870*b*, are securely connected to the sidewalls 1840 of the container assembly 1800. The handling devices 1870 are sized and configured so a user can grip the handles to lift or otherwise move and position the entire container assembly 1800 and its contents, if any. For example, the second handles 1870*b* are attached to the sidewalls 1840 on opposite sides of the container assembly 1800. In one embodiment, the handling devices 1870 are configured to removably receive an automated device or machine (e.g., a forklift) that can engage and lift or move the container assembly.

The first handling device 1870*a* can also be used to secure or hold the assembly 1800 in a selected position. For instance, in one embodiment the assembly 1800 is sized and configured to hang from a headrest or other portion of an automobile seat and extend downwardly along the back of the automobile seat. The assembly 1800, when in the deployed position, can receive trash, debris, or other items while hanging on the automobile seat. The disposable assembly 1800 and its contents can then be removed from the automobile as a unit and thrown away, recycled, etc. In other embodiments, the handling devices 1870 can have other arrangements, can be coupled to other portions of the assembly 1800, and/or can have other uses.

In the illustrated embodiment, the assembly 1800 has the storage devices 1880 coupled to the sidewalls 1840 adjacent to the bottom member 1830. The storage devices 1880 and are configured to receive and hold various items. For example, the storage devices 1880 can be configured to removably receive weights to serve as ballast to increase the stability of the assembly 1800 when in the deployed position. As an example, the storage devices 1880 can be configured to receive a weighted object, such as a soda can fill with fluid, sand or the like. In other embodiments, the storage devices 1880 can have other configurations and/or be coupled to other portions of the assembly 1800. In one embodiment, ballast material 1834 is also coupled to the bottom member 1830 to increase the stability of the assembly 1800. In one embodiment, the ballast material is a heavy ring connected to the bottom member. The ring can be solid, or it can be hollow and filled with water, sand, or other selected ballast material. In other embodiments, the ballast material 1834 can have other arrangements and/or can be coupled to other portions of the assembly 1800.

FIG. 18 also has the securing devices 1875 coupled to the sidewalls adjacent to the bottom member 1830. The securing devices are configured to allow a user to secure the assembly 1800 in a specific location and/or orientation. In the illustrated embodiment, the securing devices 1875 include tabs with eyelets or holes. A stake 1876 can be driven through the holes into the ground to hold the securing devices, and thus the assembly 1800, to the ground. In other embodiments, the securing devices 1875 can have other arrangements and/or be coupled to other portions of the assembly 1800.

Figure 20:
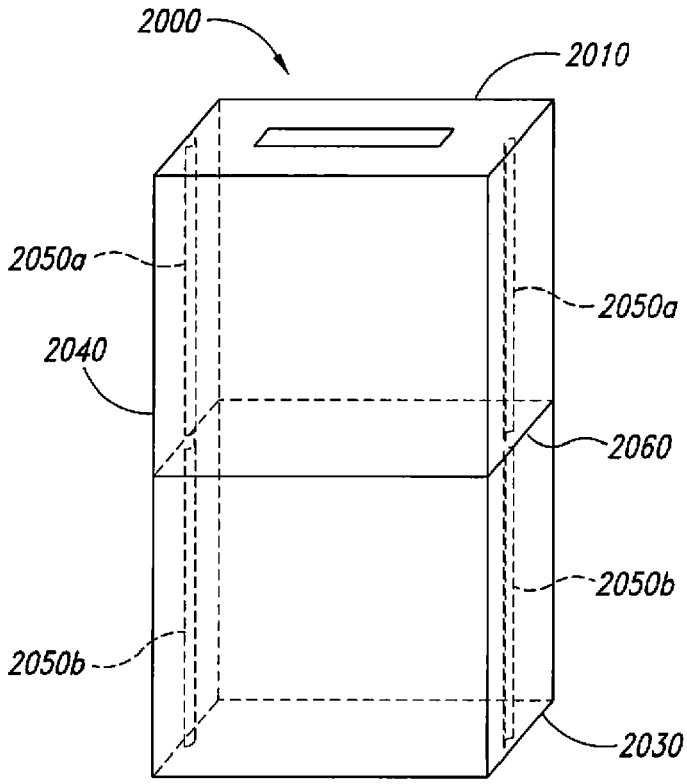
FIG. 20 is an isometric illustration of a deployable container assembly with an auxiliary support member in accordance another embodiment of the invention.

FIG. 20 is an isometric illustration of a deployable container assembly 2000 with an intermediate support member 2060 in accordance with another embodiment of the invention. In the illustrated embodiments, first struts 2050*a* extend between the top member 2010 and the intermediate support member 2060. Second struts 2050*b* extend between the intermediate support member 2060 and the bottom member 2030. Sidewalls 2040 are positioned relative to the first and second struts 2050*a* and 2050*b* to form an enclosure. In the illustrated embodiment, the first and second struts 2050*a* and 2050*b* are similar to the support members discussed above with reference to FIGS. 4 and 5. The intermediate support member 2060 includes a stiff, substantially non-bendable support member configured to act as an additional structural component for the assembly 2000. For example, in FIG. 20 the intermediate support member 2060 provides a solid ring or other support for interfacing between the first and second struts 2050*a* and 2050*b*.

Figure 21:
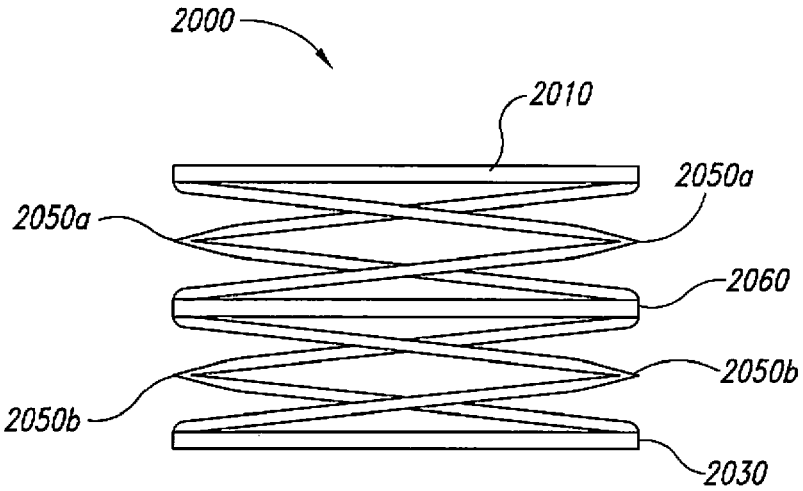
FIG. 21 is a partially schematic cross-sectional illustration of a portion of the deployable container assembly of FIG. 20 shown in a collapsed position.

FIG. 21 is a partially schematic cross-sectional illustration of a portion of the deployable container assembly 2000 of FIG. 20 shown in a collapsed position. In FIG. 21, the sidewalls 2040 are not shown for the purpose of clarity and illustration. As the assembly 2000 is moved to the collapsed position, the first struts 2050*a* are folded between the top member 2010 and the intermediate support member 2060. Similarly, the second struts 2050*b* are folded between the intermediate support member 2060 and the bottom member 2030. In certain embodiments, the intermediate support member can add strength and/or rigidity to the assembly 2000. In other embodiments, the intermediate support member 2060 can have some flexibility so that the assembly 2000 can have a selected collapsed and/or deployed shape or profile.

Figure 22:
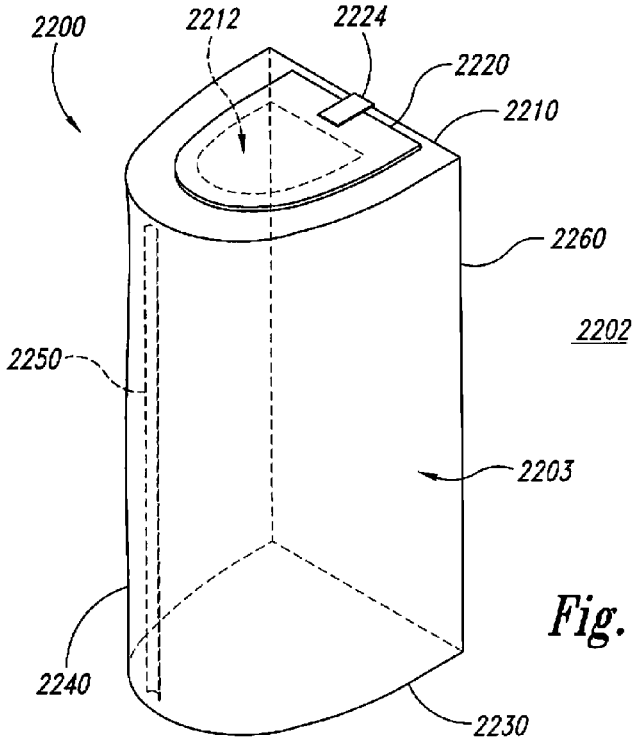
FIG. 22 is an isometric illustration of a deployable container assembly with a closure device in accordance with an embodiment of the invention.

FIG. 22 is an isometric illustration of a deployable container assembly 2200 with a closure device 2220 in accordance with another embodiment of the invention. The assembly 2200 includes an intermediate support member 2260 that extends between the top member 2210 and the bottom member 2230. In the illustrated embodiment, the intermediate support member 2260 forms a substantially rigid or semi-rigid back wall positioned generally opposite a strut 2250, which is similar to the support member discussed above. The back wall provides vertical and lateral support to the assembly 2000 that works in conjunction with the support and stability of the strut 2250. The sidewalls 2040 are positioned around the intermediate support member 2060 and the strut 2050 to form an enclosure having an interior area 2203 configured to receive items when the assembly 2200 is in the deployed position. The top member 2210 includes an opening

2212 that provides access to the interior area 2203. In the illustrated embodiment, the opening 2212 is coverable by a closure device 2220 coupled to a biasing mechanism 2224. In FIG. 22, the closure device 2220 is shown in the closed position.

Figure 23:
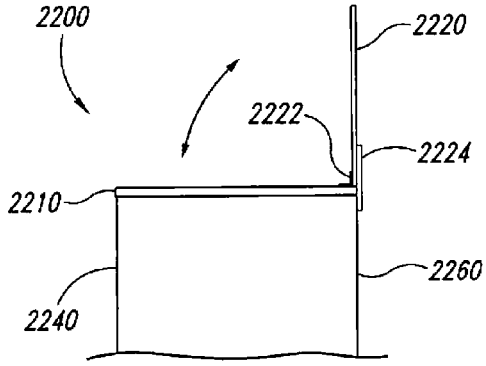
FIG. 23 is a partially schematic side elevation view of a portion of the deployable container assembly of FIG. 22 with the closure device in an open position.

FIG. 23 is a partially schematic side elevation of a portion of the deployable container assembly 2200 of FIG. 22 with the closure device 2220 in an open position. In FIG. 23, the biasing mechanism 2224 is coupled to the closure device 2220 and the auxiliary support member 2260. The biasing mechanism 2224 includes an elongated flexible member with a concave portion, similar to the shape of the struts discussed above with reference to FIGS. 4 and 5. When the closure device 2220 is in the closed position (FIG. 22), the biasing mechanism 2224 is partially folded (e.g., in a folded position) and part of the concave portion of the biasing mechanism 2224 is generally flattened (similar to the struts shown in FIG. 5). In selected embodiments, the flatten portion allows the closure device 2220 to remain the closed position and/or resists movement toward the open position. When the closure device 2220 is in the open position, the concave portion of the biasing mechanism 2224 is not flattened (e.g., in an extended position similar to the support member shown in FIG. 4). In this extended position, the biasing mechanism 2224 can resist movement of the closure device 2220 toward the closed position and/or movement away from the open position.

In selected embodiments, the biasing mechanism 2224 can hold the closure device 2220 in the open position while the interior area 2203 of the assembly 2200 is being accessed and can hold the closure device in the closed position after the interior area 2203 has been accessed. In other embodiments the biasing mechanism 2224 can have other arrangements. For example, the biasing mechanism 2224 can be coupled between the closure device 2220 and other portions of the assembly (e.g., a portion of a foldable support member). In still other embodiments the biasing mechanism 2224 can include other devices (e.g., a spring device and or a detent arrangement) that work with the closure device 2220 to hold it open or closed as desired.

Figure 24:
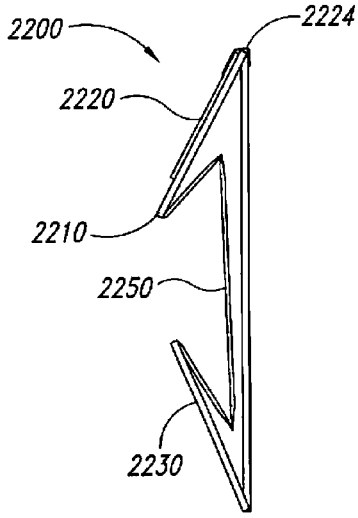
FIG. 24 is a partially schematic cross-sectional illustration of a portion of the deployable container assembly of FIG. 22 shown in a collapsed position.

FIG. 24 is a partially schematic cross-sectional illustration of a portion of the deployable container assembly 2200 of FIG. 22 shown in a collapsed position. As shown in the illustrated embodiment, the intermediate support member 2260 can be hinged relative to the top and bottom surface members 2210 and 2230 (e.g., via tape, a flexible material, or a multi-piece hinge). As the assembly 2200 is collapsed, the bendable struts 2250 can be folded in multiple locations as portions of the top and bottom surface members 2210 and 2230 are rotated toward one another.

Figure 25:
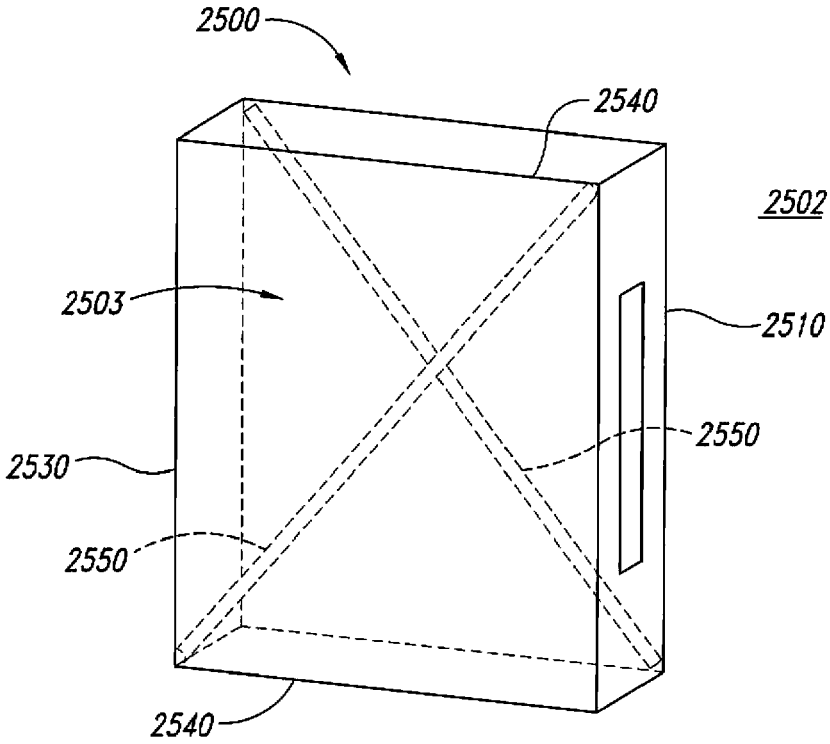
FIG. 25 is an isometric illustration of a deployable container assembly with at least one external support member in accordance with an embodiment of the invention.

FIG. 25 is an isometric illustration of a deployable container assembly 2500 with at least one external support member 2250 in accordance with another embodiment of the invention. In FIG. 25, the assembly 2500 includes a first end member 2510 laterally disposed from a second end member 2530 with sidewalls 2540 extending there between to form an enclosure with an interior area 2503 and an exterior 2502. Two foldable struts 2250 extend diagonally between the end members 2210 and 2230 and are located on the exterior 2502 of the assembly 2500.

Figure 26:
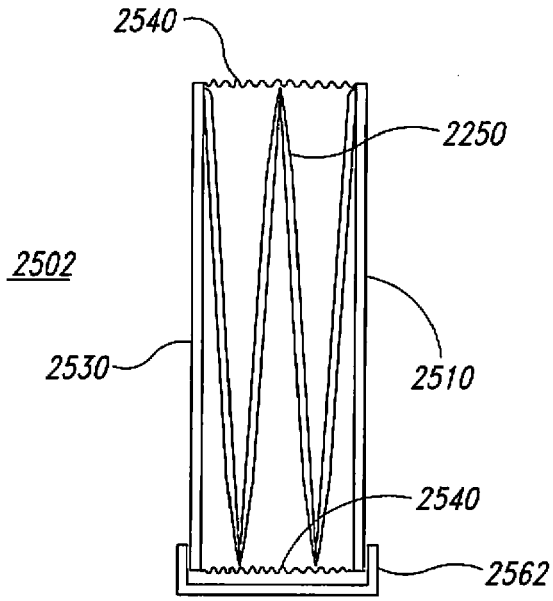
FIG. 26 is a partially schematic cross-sectional illustration of a portion of the deployable container assembly of FIG. 25 shown in a collapsed position.

FIG. 26 is a partially schematic cross-sectional illustration of a portion of the deployable container assembly 2500 of FIG. 25 shown in a collapsed position. In the illustrated embodiment, when moving the assembly 2500 from a deployed position to a collapsed position, the struts 2550 are folded in multiple locations and remain on the exterior of the assembly 2500. In selected embodiments, the struts 2550 can be removed from the end members 2510, and 2530 and sidewalls. For example, struts 2550 can be removed after the assembly's interior area 2503 has been filled or partially filled with items, such as trash, and the filled assembly (except for the struts) can be thrown away or recycled as a unit.

The assembly 2500 in FIG. 26 also includes a removable stowing device 2562, such as a clamp or clip, that engages and holds the assembly 2500 in the collapsed position. In certain embodiments, the assembly 2500 can automatically move the deployed position when the stowing device 2562 is removed. In other embodiments, a user must begin to move the assembly 2500 from the collapsed position toward the deployed position after removing the stowing device 2562, and after moving past an intermediate position, the assembly will automatically move to the fully deployed position. In other embodiments, the stowing device 2562 is configured to store the assembly in the collapsed position and to protect it from inadvertently moving toward the deployed position, such as during shipping or storage. The stowing device 2562 can have other arrangements (e.g., the stowing device can include tape or shrink wrap) in other embodiments.

Figure 27:
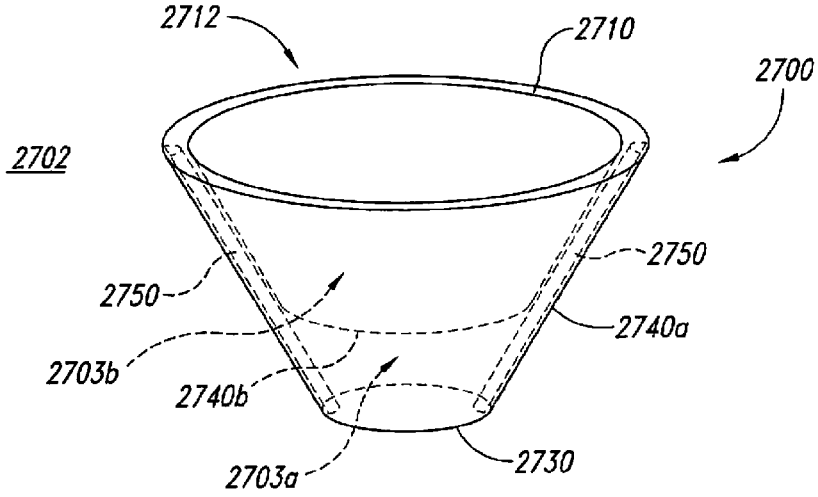
FIG. 27 is an isometric illustration of a deployable container assembly with inner and outer sidewalls in accordance with an embodiment of the invention.

FIG. 27 is an isometric illustration of a deployable container assembly 2700 with a double sidewall 2740 configuration with an inner sidewall **2740*b* and an outer sidewall 2740*a*. In the illustrated embodiment, the assembly 2700 includes foldable struts 2750 extending between a top member 2710 and a bottom member 2730. The top member 2710 includes a rigid or semi-rigid disk with an opening 2712 therein. An outer sidewall 2740*a* extends between an outer portion of the top member 2710 and the bottom member 2730. The inner sidewall 2740*b* extends downwardly from an inner portion of the top member 2710 and is closed at the bottom forming a cavity or second interior 2703*b* that can be accessed through the opening 2712. In the illustrated embodiment, the struts 2750 are positioned in a first interior 2703*a* between the inner sidewall 2740*b* and the outer sidewall 2740*a*. The struts 2750 are similar to the struts discussed above with reference to FIGS. 4 and 5 and can be folded to move the assembly 2700** between the deployed position to a collapsed position.

In certain embodiments, the assembly 2700 can include a porous inner sidewall and a water resistant outer sidewall. The assembly can be used as a collapsible and/or disposable container that allows for fluid drainage through the inner sidewalls **2740*b*. The outer sidewall 2740*a* can be used to add additional integrity to the assembly 2700 in case the inner sidewall 2740*b* is punctured. In still other embodiments, the inner sidewall 2740*b* can deform as items are added to the interior area, while the outer sidewall 2740*a* retains a substantially fixed shape in the deployed position (e.g., so that the assembly 2500 can fit into a selected space and/or can retain an aesthetically pleasing shape). In yet other embodiments, insulating material can be placed between the inner and outer sidewalls 2740*b* and 2740*a* (e.g., when the assembly 2700 is used as a cooler). In other embodiments, the struts 2750 can be positioned inside the inner sidewall 2740*b* and/or outside of the outer sidewall 2740*a***.

Figure 28:
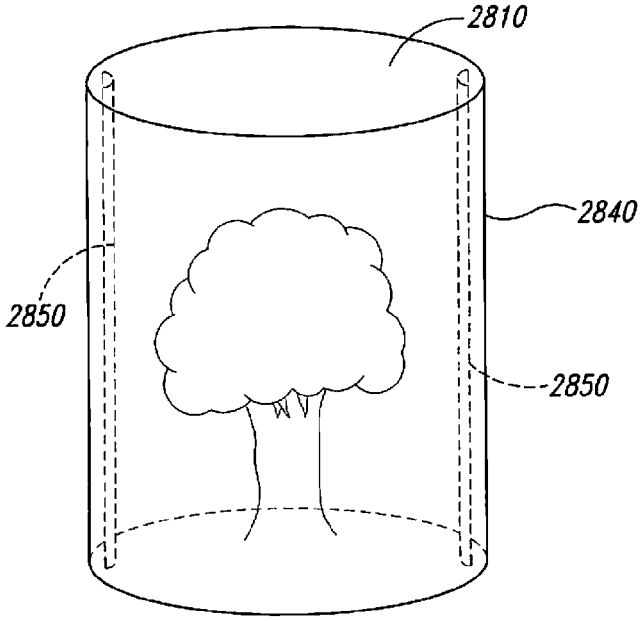
FIG. 28 is an isometric illustration of a deployable container assembly in accordance with an embodiment of the invention.

FIG. 28 is an isometric illustration of a deployable container assembly 2800 without a bottom member in accordance with another embodiment of the invention. In one embodiment, the assembly 2800 could use a ring as the bottom member 2830 so that the sidewalls 2840 are supported, and the end of the assembly is open. In FIG. 28, the assembly 2800 includes a top member 2810 and foldable struts 2850 extending away from the top member 2810 and configured to support a top member 2840. In one embodiment, the top member 2810 is a generally planar member without an opening therein. The struts 2850 are similar to the support member discussed above with reference to FIGS. 4 and 5. Accordingly, the assembly 2800 can be collapsed by folding the struts 2850 and the sidewalls 2840 relative to the top member. In the illustrated embodiment, the assembly 2800 can be used as a collapsible cover for items. For example, the assembly 2800 could be used as a frost cover for plants.

Figure 29:
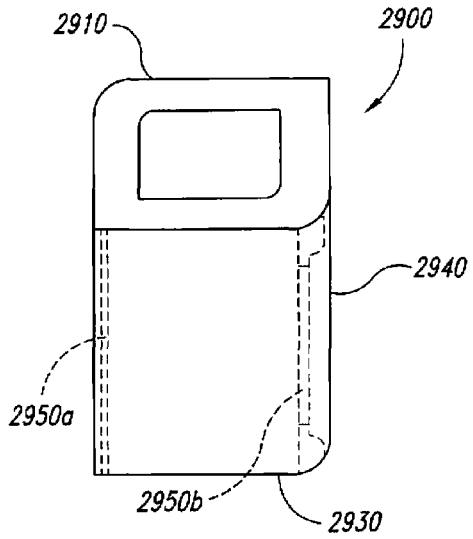
FIG. 29 is an isometric illustration of a deployable container assembly with a hinge device coupled to a support member in accordance with an embodiment of the invention.

FIG. 29 is an isometric illustration of a deployable container assembly 2900 with a hinge device coupled to at least one support member 2950 in accordance with another embodiment of the invention. The assembly 2900 includes two foldable support members 2950, shown as a first foldable support member 2950*a* and a second foldable support member 2950*b*. The foldable support members 2950 extend between the top member 2910 and the bottom member 2930. A sidewall 2940 is coupled to the top and bottom members 2910 and 2930 and extend around the support members 2950 to form an enclosure when the assembly 2900 is in the deployed position.

Figure 30:
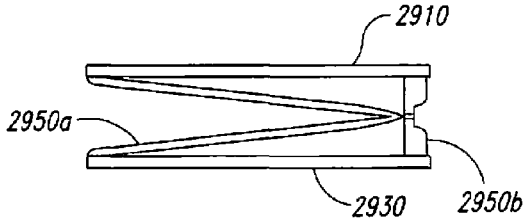
FIG. 30 is a partially schematic cross-sectional illustration of a portion of the deployable container assembly of FIG. 29 shown in a collapsed position.

FIG. 30 is a partially schematic cross-sectional illustration of a portion of the deployable container assembly 2900 of FIG. 29 shown in a collapsed position with the sidewalls 2940 removed for the purpose of clarity and illustration. As the assembly 2900 collapses, the first support member 2950*a* folds in a first direction relative to the top member 2910 and the second support member 2950*b* folds in a second direction at least approximately perpendicular to the first direction. In addition to folding, the first and second support members 2950*a* and 2950*b* are pivotally connected to the top and bottom members 2910 and 2930. Accordingly, as the support members 2950 fold, the hinges also allow portions of the support members 2950 to pivot relative to the top and bottom members 2910 and 2930.

Figure 31:
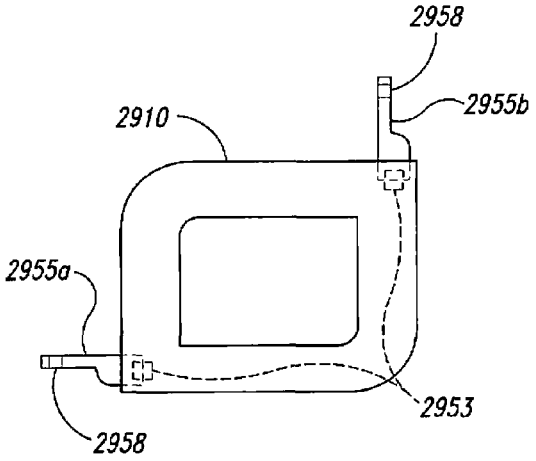
FIG. 31 is a partially schematic illustration of a surface member of the deployable container assembly of FIG. 29.

FIG. 31 is a partially schematic illustration of the top member 2910 of the deployable container assembly 2900 of FIG. 29. A first part 2955*a* of the first support member 2950*a* is coupled to the top member 2910 via a hinge device 2953 and a first part 2955*b* of the second support member 2950*b* is coupled to the top member 2910 via another hinge device 2953. Accordingly, the hinge devices 2953 allow the support members 2950 to pivot relative to at least the top members 2910 when the assembly 2900 moves between the collapsed and deployed positions. In the illustrated embodiment, the hinge devices 2953 include a flexible adhesive member (e.g., a piece of high strength tape). In other embodiments, the hinge devices 2953 can include more complex devices (e.g., a multiple piece mechanical hinge) and/or hinge devices 2953 that allows movement in one or multiple axes.

Figure 32:
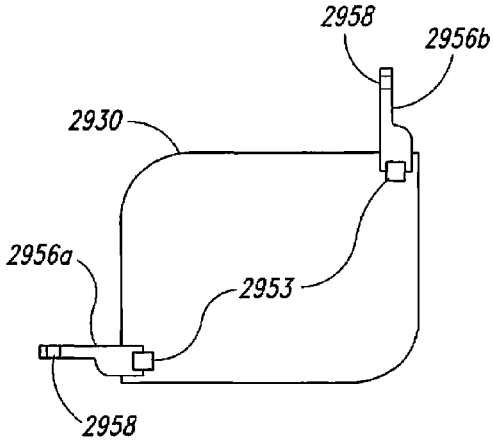
FIG. 32 is a partially schematic illustration of another surface member of the deployable container assembly of FIG. 29.

FIG. 32 is a partially schematic illustration of the bottom member 2930 of the collapsible container assembly 2900 of FIG. 29. A second part 2956*a* of the first support member 2950*a* is coupled to the bottom member 2930 via a hinge device 2953 and a second part 2956*b* of the second support member 2950*b* is coupled to the bottom member 2930 via another hinge device 2953. As discussed in further detail below, when the assembly 2900 is fully assembled, the first part 2955*a* of the first support member 2950*a* is coupled to the second part 2956*a* of the first support member 2950*a* by a concave strut 2957*a* of the first support member 2950*a*. Similarly, the first part 2955*b* of the second support member 2950*b* is coupled to the second part 2956*b* of the second support member 2950*b* by a concave strut (shown schematically in FIG. 29) of the second support member 2950*b*. The first parts 2955*a*/2956*a* and the second parts 2955*b*/2956*b* can be made of a substantially stiff material, such as cardboard, plastic, wood, metal, composite, or other sufficiently stiff materials.

Figure 33:
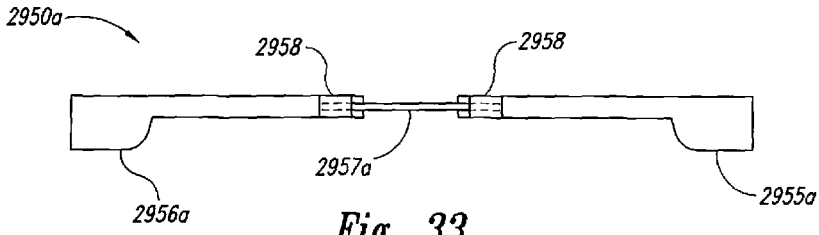
FIG. 33 is a partially schematic illustration of a support member of the deployable container assembly of FIG. 29.

FIG. 33 is a partially schematic illustration of the first support member 2950*a* of the deployable container assembly 2900 of FIG. 29. In FIG. 33, the concave strut 2957*a* of the first support member 2950*a* is shown coupled to the first part 2955*a* and the second part 2956*a* of the first support member 2950*a*. In the illustrated embodiment, the concave strut 2957*a* is coupled to the first part 2955*a* and the second part 2956*a* by one or more fasteners 2958. In selected embodiments, the fasteners 2958 can include tape, adhesive, clips, rivets, screws, bolts, and the like. The concave strut 2957*a* includes a concave portion or concave cross-section and folds/operates similarly to the struts discussed above with reference to FIGS. 4 and 5. Accordingly, the first support member 2950*a* can be folded across a portion of the concave strut 2957*a* as the assembly 2900 is moved to the collapsed position. In the unfolded position, the concave strut 2957*a* aligns with the first and second parts of the support member (i.e. generally co-planar), so that the support member can resist vertical loads applied to the top and/or bottom members 2910 and 2930, so that the assembly 2900 will remain in the deployed position.

In one embodiment, the fasteners 2958 can be integral with the concave part 2957*a*, the first part 2955*a*, and/or the second part 2956*a*. In other embodiments, the concave part 2957*a* can be inserted into pockets in the first and second parts 2955*a* and 2956*a*. In a selected embodiment, the concave part 2957*a* and the pockets can include a detent feature to provide a secure connection.

Figure 34:
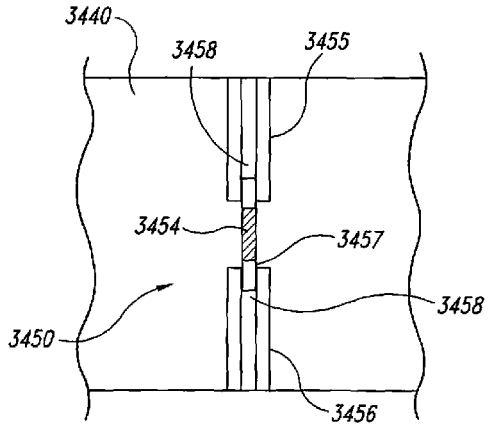
FIG. 34 is a partially schematic illustration of a sidewall of a deployable container assembly with at least a portion of a support member integral to the sidewall in accordance with an embodiment of the invention.

FIG. 34 is a partially schematic illustration of a first surface member 3440 of a deployable container assembly 3400 with at least a portion of a support member 3450 integral to the sidewall 3440 in accordance with another embodiment of the invention. In FIG. 34, the assembly 3400 includes at least one strut structure having a first portion 3455 and a second portion 3456. The first portion 3455 and/or second portion 3456 can be integral with the sidewalls 3440. For example, the sidewalls 3440 can be made of a plastic material, and the first and second portions 3455 and 3456 can be integrally formed in the same plastic material via a melt phase process. In other embodiments, the first and second portions 3455 and 3456 can be formed from other material and/or by other processes.

In the illustrated embodiment, a strut portion 3457 of the support member 3450 is coupled to the first and second portions 3455 and 3456 via fasteners 3458. In FIG. 34, the fasteners 3458 include grooves formed in the first and second portions 3455 and 3456 and the strut portion 3457 is inserted into the grooves and retained in the grooves via friction. In other embodiments, the fasteners 3458 can have other arrangements. As discussed above, in the illustrated embodiment, the strut portion 3457 has a concave cross-section and folds/operates similarly to the struts discussed above with reference to FIGS. 4 and 5. Accordingly, the support member 3450 can have a collapsed position where the strut portion 3457 is folded and a deployed position where the concave portion 3457 is at least approximately unfolded. In one embodiment, the strut portion 3457 is made of thin metal, plastic or other suitable material without a significant memory for the folded position, as discussed above. In another embodiment, the strut portion 3457 is a distinct portion but is integrally connected to the first and second portions 3455 and 3456.

In one embodiment, the support member 3450 includes a layer of sound insulation 3454 coupled to the concave portion 3457 to reduce any noise made by the concave portion 3457 of the support member 3450 as it is folded and unfolded. In the illustrated embodiment, the layer of sound insulation 3454 is a tape material, although in other embodiments the sound insulation 3454 can have other configurations, such as spray on coating.

Figure 35:
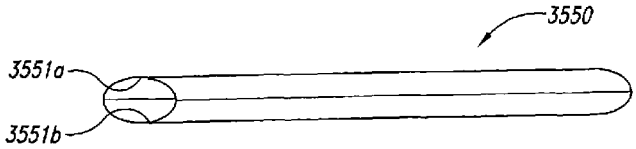
FIG. 35 is an isometric illustration of a support member of a deployable container assembly in accordance with an embodiment of the invention.

FIG. 35 is an isometric illustration of a strut 3550 of a deployable container assembly in accordance with still another embodiment of the invention. In FIG. 35, the strut 3550 includes multiple concave portions 3551 with concave cross-sections, shown as a first concave portion 3551*a* and a second concave portion 3551*b*. The strut 3550 in FIG. 35 folds or operates similar to the strut shown in FIGS. 4 and 5. Accordingly, the first and second concave portions 3551*a* and 3551*b* can support vertical loads and resist bending or folding as long as the concave cross-sections remain substantially undisturbed. However, once a threshold force is exceed, a portion of the concave cross-section flattens out and allows the strut 3550 to fold. Once the strut 3550 is unfolded and the concave cross-sections return, the strut 3550 will again support vertical loads and resist bending.

Figure 36:
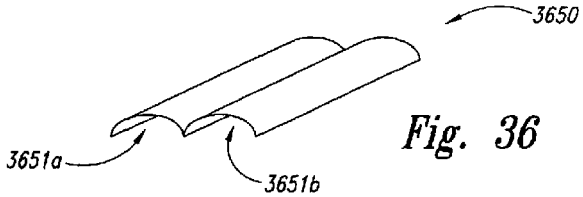
FIG. 36 is an isometric illustration of a support member of a deployable container assembly in accordance with an embodiment of the invention.

The strut 3550 shown in FIG. 35 can have other arrangements. For example, FIG. 36 illustrates another strut 3650 with multiple concave sections 3651. In FIG. 36, the strut 3650 includes multiple concave portions 3651 with concave cross-sections, shown as a first concave portion 3651*a* and a second concave portion 3651*b* positioned side by side. The strut 3650 folds or operates similar to the strut shown in FIGS. 4 and 5. Accordingly, the first and second concave portions 3651*a* and 3651*b* will support vertical loads and resist bending or folding as long as the concave cross-sections remain undisturbed. However, once a threshold force is exceed, a portion of the concave cross-section flattens out and allows the strut 3650 to fold. Once the strut 3650 is unfolded and the concave cross-sections return, the strut 3550 will again support vertical loads and resist bending. In other embodiments, the support member 3650 can have more or fewer concave portions.

Figure 37:
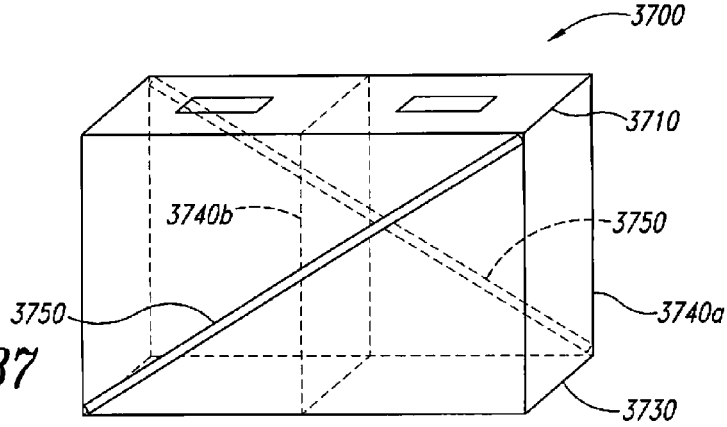
FIG. 37 is an isometric illustration of a deployable container assembly with multiple compartments in accordance with an embodiment of the invention.

FIG. 37 is an isometric illustration of a deployable container assembly 3700 with multiple compartments in accordance with still another embodiment of the invention. The assembly in FIG. 37 includes strut 3750 extending between a top member 3710 and a bottom member 3730. The top and bottom members 3710 and 3730 carry an outer sidewall 3740*a* and/or an inner sidewall 3740*b*. The outer sidewall 3740*a* forms an exterior surface of the assembly 3700. The inner sidewall 3740*b* forms a divider wall within the assembly. The divider can be positioned to segregate the interior of the assembly 3700 into multiple compartments. For example, in certain embodiments one compartment can be used as a disposable cooler and the other compartment can be used as a disposable trash container. In other embodiments, the assembly 3700 can have more or fewer compartments.

Figure 38:
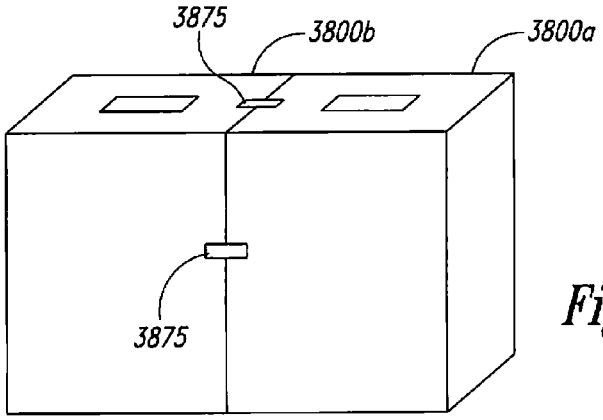
FIG. 38 is an isometric illustration of two deployable container assemblies coupled together in accordance with an embodiment of the invention.

FIG. 38 is an isometric illustration of a first deployable container assembly 3800*a* coupled to a second deployable container assembly 3800*b* in accordance with another embodiment of the invention. In FIG. 38, the first and second assemblies 3800*a* and 3800*b* include deployable containers in accordance with one or more of the various embodiments described above. The first and second assemblies 3800*a* and 3800*b* are coupled together via one or more securing devices 3875. In the illustrated embodiment, the securing devices 3875 include tape or Velcro®, although other embodiments can have the securing devices 3875 with other arrangements. For example, in selected embodiments the securing device 3875 can include straps that extend around portions of each of the assemblies 3800*a* and 3800*b*.

Figure 39:
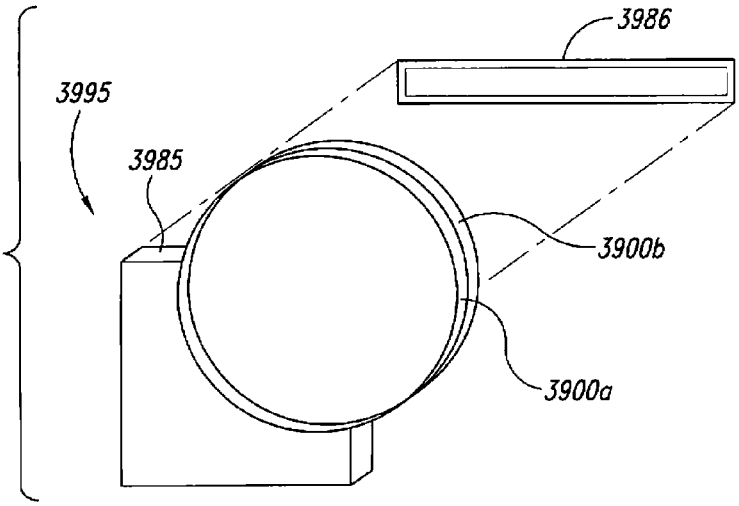
FIG. 39 is an isometric illustration of a packaged assembly that includes a packaging device with at least one deployable container assembly in accordance with an embodiment of the invention.

FIG. 39 is an isometric illustration of a packaged assembly 3995 that includes a packaging device 3985 with at least one deployable container assembly 3900 in accordance with another embodiment of the invention. In FIG. 39, the packaging device 3985 is configured to carry multiple assemblies 3900, shown as a first container assembly 3900*a* and a second container assembly 3900*b*, both in the collapsed configuration. In the illustrated embodiment, the packaging device 3985 is configured to be self supporting so that it can hold and dispense the multiple assemblies 3900 as needed. The packaging device 3985 of the illustrated embodiment is configured to be loaded with the multiple container assemblies 3900, shipped as a unit, and used as a storage device for use by an end user. The packaging device can also be used as a display and dispensing device at a point of sale location. In selected embodiments, the packaging device 3985 can include one or more restraint devices 3986 configured to releasably restrain each of the assemblies 3900 in the packaging device 3985 until the packaged assembly 3995 is sold and/or until each of the assemblies 3900 have been dispensed.

In other embodiments the packaged assembly can have other arrangements. For example, in other embodiments the restraint device(s) 3986 can include a holding rack and a wrapping material, such as shrink wrap extending around the holding rack and the assemblies 3900. The shrink wrap can be removed and the assemblies dispensed directly from the holding rack. In other embodiments, the packaging device 3985 can have other configurations and/or can carry more or fewer assemblies 3900.

A feature of some of the embodiments discussed above is that a deployable container assembly can be easy to store and convenient to use. Additionally, in certain embodiments the container assemblies can be disposable, recyclable, and/or biodegradable. Various uses for bins in accordance with embodiments of the invention can include a trash bin, a recycling bin, a laundry bin, a dry cleaning bin, a storage bin, a cooler, a flower/plant pot, a cover to protect plants from frost (e.g., a bin without a bottom). As noted above, the bin can have multiple cavities so that it can be used for multiple purposes. For example, a bin having three cavities can be used as a combination cooler, garbage bin, and recycle bin.

From the foregoing, it will be appreciated that specific embodiments of the invention have been described herein for purposes of illustration, but that various modifications may be made without deviating from the invention. Additionally, aspects of the invention described in the context of particular embodiments may be combined or eliminated in other embodiments. Furthermore, while advantages associated with certain embodiments of the invention have been described in the context of those embodiments, other embodiments may also exhibit such advantages, and not all embodiments need necessarily exhibit such advantages to fall within the scope of the invention. Accordingly, the invention is not limited except as by the appended claims.

We claim:

1. A disposable, deployable, collapsible waste container assembly comprising:

an interior frame support structure comprising:

a base being planar and substantially stiff;

a top ring defining an upper opening, the top ring being substantially stiff;

a foldable unitary, monolithic support member having a length, a width, a top end connected to the top ring, a bottom end connected to the base, and a middle portion extending between the top and bottom end, the support member extending continuously between the base and the top ring;

an exterior enclosure surrounding the interior frame support structure, the exterior enclosure being flexible, collapsible, and substantially liquid impervious, the exterior enclosure comprising:

a closed bottom portion;

an open top portion;

a circumferential sidewall extending continuously along the support member and between the closed bottom portion and the open top portion;

wherein the top ring and the top end of the support member of the interior frame support structure are connected to the open top portion of the exterior enclosure and the base and the bottom end of the support member of the interior frame support structure are connected to the closed bottom portion of the exterior enclosure;

a deployed assembly configuration where:

the interior frame support structure is free-standing and the support member is deployed in a substantially straight, extended, and unfolded arrangement, extending along a longitudinal axis, the support member having an arcuate, concave cross-sectional shape enabling the support member to support axial loads and to resist bending at the middle portion until a threshold force is exceeded;

the top ring is spaced apart from the base by the support member with the top ring parallel to the base, the circumferential sidewall deployed along the longitudinal axis and extending along the support member between the top ring and the base, the upper opening of the top ring provides waste disposal access to an interior defined by the exterior enclosure;

a collapsed assembly configuration where:

the interior frame support structure is collapsed and the support member is in a folded arrangement, the support member being folded in half across the length of the support member and at the middle portion, the top end folded upon the bottom end and the top end positioned directly adjacent to the bottom end, the support member having a flattened profile at the middle portion different from the arcuate, concave cross-sectional shape:

the top ring is parallel and adjacent to the base and the circumferential sidewall is collapsed between the top ring and the base.

2. The assembly of claim 1, further comprising a closure device connected to the exterior enclosure, the closure device being movable between an open position and a closed position, in the open position the interior being accessible via the upper opening, in the closed position the closure device covering at least a portion of the upper opening.

3. The assembly of claim 1 wherein the support member includes a metallic material treated with a rust accelerant.

4. The assembly of claim 1 wherein the top ring is spaced above the base and the support member is substantially vertically oriented when the assembly is in the deployed assembly configuration.

5. The assembly of claim 1 wherein the top ring, the base, the support member, and the circumferential sidewall are made of one or more recyclable materials.

6. The assembly of claim 1 wherein the exterior enclosure includes a flexible plastic material.

7. The assembly of claim 1 wherein the support member is a first support member, and the assembly further comprising a second foldable support member extending continuously between the base and the top ring and in the deployed assembly configuration having an arcuate, concave cross-sectional shape.

8. The assembly of claim 1, further comprising a closure device connected to the open top portion of the exterior enclosure, the closure device being movable relative to the upper opening between an open position and a closed position, in the open position the interior being accessible via the opening, in the closed position the closure device causing the open top portion to cover at least a portion of the opening.

9. The assembly of claim 1 wherein the exterior enclosure includes a corn resin material.

10. The assembly of claim 1 wherein, in the collapsed assembly configuration, the support member is biasing away from the collapsed assembly configuration.

11. The assembly of claim 1, further comprising a closure member connected to the open top portion of the exterior enclosure, the open top portion being configured to fold over on itself when in a folded open position, and when the closure member is in an open arrangement, and the open top portion of the exterior enclosure is configured to be moved to an unfolded closed position wherein the closure member holds the open top portion of the exterior enclosure in the unfolded closed position with the internal frame within the exterior enclosure.

12. The assembly of claim 1 wherein the base of the interior frame support structure is a ring.

13. The assembly of claim 1 wherein the base is a closed base.

14. The assembly of claim 1 wherein the exterior enclosure is configured to contain waste material, including at least one of trash, recyclable, and compostable material.

15. The assembly of claim 1 wherein the closed bottom portion and the open top portion of the exterior enclosure are integrally connected to the circumferential sidewall.

16. The assembly of claim 1, further comprising a stowing device that holds the assembly in the collapsed assembly configuration.

17. The assembly of claim 16 wherein, in the collapsed assembly configuration, the support member is biasing away from the collapsed assembly configuration.

* * * * *